US011043328B2

(12) United States Patent
Moriya et al.

(10) Patent No.: US 11,043,328 B2
(45) Date of Patent: Jun. 22, 2021

(54) COIL COMPONENT

(71) Applicant: SUMIDA CORPORATION, Tokyo (JP)

(72) Inventors: Hitoshi Moriya, Natori (JP); Yoshimasa Abe, Natori (JP)

(73) Assignee: SUMIDA CORPORATION

( * ) Notice: Subject to any disclaimer, the term of this patent is extended or adjusted under 35 U.S.C. 154(b) by 295 days.

(21) Appl. No.: 16/166,979

(22) Filed: Oct. 22, 2018

(65) Prior Publication Data

US 2019/0148055 A1 May 16, 2019

(30) Foreign Application Priority Data

Nov. 10, 2017 (JP) ..... JP2017-217502

(51) Int. Cl.

| | |
|---|---|
| ***H01F 27/24*** | (2006.01) |
| ***H01F 27/29*** | (2006.01) |
| ***H01F 5/04*** | (2006.01) |
| ***H01F 17/04*** | (2006.01) |
| ***H01F 27/28*** | (2006.01) |

(52) U.S. Cl.

CPC ..... *H01F 27/292* (2013.01); *H01F 5/04* (2013.01); *H01F 17/045* (2013.01); *H01F 27/24* (2013.01); *H01F 27/2823* (2013.01)

(58) Field of Classification Search

CPC ..... H01F 27/292; H01F 5/04; H01F 17/045; H01F 17/2823; H01F 27/00–40

See application file for complete search history.

(56) References Cited

U.S. PATENT DOCUMENTS

| | | | | |
|---|---|---|---|---|
| 9,202,620 | B2 * | 12/2015 | Arimitsu ..... | H01F 17/045 |
| 10,163,559 | B2 * | 12/2018 | Igarashi ..... | H01F 17/045 |
| 10,468,177 | B2 * | 11/2019 | Igarashi ..... | H01F 17/045 |
| 2006/0267719 | A1 * | 11/2006 | Yasuda ..... | H01F 27/027 336/223 |
| 2008/0003864 | A1 * | 1/2008 | Hatakeyama ..... | H01F 27/292 439/399 |
| 2015/0042436 | A1 | 2/2015 | Arimitsu et al. | |
| 2017/0288626 | A1 | 10/2017 | Kobayashi et al. | |
| 2018/0330869 | A1 | 11/2018 | Kim et al. | |

FOREIGN PATENT DOCUMENTS

| | | | |
|---|---|---|---|
| JP | 2005-093564 | A | 4/2005 |
| JP | 2012-089804 | A | 5/2012 |
| WO | WO-2017-086626 | A1 | 5/2017 |

OTHER PUBLICATIONS

Extended European Search Report for Patent Application No. EP18205276.1, dated Apr. 18, 2019 (14 pages).

* cited by examiner

*Primary Examiner* — Tuyen T Nguyen

(74) *Attorney, Agent, or Firm* — Harness, Dickey & Pierce, P.L.C.

(57) ABSTRACT

A coil component including: a core that is configured with a shaft and first and second flanges, the first and second flanges being formed at first and second opposite ends of the shaft; first and second wires that are wound around the shaft; and a plurality of metal terminals to which both wire ends of each of the first and second wires are connected, respectively. A notch is formed in both ends in a first direction of an opposite surface of each of the first and second flanges. The opposite surface faces a mounting surface on which the coil component is mounted. The first direction is perpendicular to an axial direction of the shaft. At least part of each of the plurality of metal terminals is disposed in the notch.

11 Claims, 30 Drawing Sheets

COIL COMPONENT

CROSS-REFERENCE TO RELATED APPLICATION

This application claims priority to Japanese Patent Application No. 2017-217502 filed Nov. 10, 2017 which is hereby expressly incorporated by reference herein in its entirety.

BACKGROUND

1. Technical Field

The present invention relates to a coil component.

2. Related Art

In Japanese Publication Number 2005-93564, a coil component, which is configured with a core (a drum core in the Japanese publication), first and second wires (two wires in the Japanese publication), and a plurality of metal terminals (an electrode member in the Japanese publication), is disclosed. Specifically, the core has a shaft part (a winding core part in the Japanese publication) and flange parts (a flange part in the Japanese publication). The flange parts are formed on both ends of the shaft part, respectively. The first and second wires are wound around the shaft part. Further, the plurality of metal terminals are respectively connected to the corresponding wire ends of both ends of the first wire and both ends of the second wire.

In regards to the coil component in the Japanese publication, the metal terminal has a vertical part, a bottom part, and a connection part. Specifically, the vertical part is located along an external surface of the flange part. The bottom part is bent along the bottom surface of the flange part. The connection part projects from a position close to an upper end of the vertical part in a horizontal direction as the connection part is slightly away from the core. The wire end is connected to the connection part of the metal terminal.

However, with respect to the configuration of the coil component in Japanese Publication Number 2005-93564, the coil component in an axial direction of the shaft part increases in size.

In addition, it is considered that the process, in which the wire end is connected to the connection part of the metal terminal by utilizing an automatic winding machine, is extremely complicated. Therefore, in regards to the manufacturing easiness of the coil component, there is still room for improvement.

SUMMARY

An object of the present invention is to provide a coil component having a configuration that can solve at least one of the problems explained above.

In order to achieve the above object, a coil component according to one aspect of the present invention includes: a core that is configured with a shaft and first and second flanges, the first and second flanges being formed at first and second opposite ends of the shaft; first and second wires that are wound around the shaft; and a plurality of metal terminals to which both wire ends of each of the first and second wires are connected, respectively. A notch is formed in both ends in a first direction of an opposite surface of each of the first and second flanges. The opposite surface faces a mounting surface on which the coil component is mounted. The first direction is perpendicular to an axial direction of the shaft. At least part of each of the plurality of metal terminals is disposed in the notch.

A coil component according to another aspect of the present invention includes: a core that is configured with a shaft and first and second flanges, the first and second flanges being formed at first and second opposite ends of the shaft; and a plurality of metal terminals to which both wire ends of each of first and second wires are connected, respectively, the first and second wires being wound around the shaft. A notch is formed in both ends in a first direction of an opposite surface of each of the first and second flanges. The opposite surface faces a mounting surface on which the coil component is mounted. The first direction is perpendicular to an axial direction of the shaft. At least part of each of the plurality of metal terminals is disposed in the notch.

According to the present invention, at least one of a suppression of the size of a coil component in an axial direction of a shaft and good manufacturing easiness of a coil component can be achieved.

DESCRIPTION OF EXEMPLARY EMBODIMENTS

Figure 1:
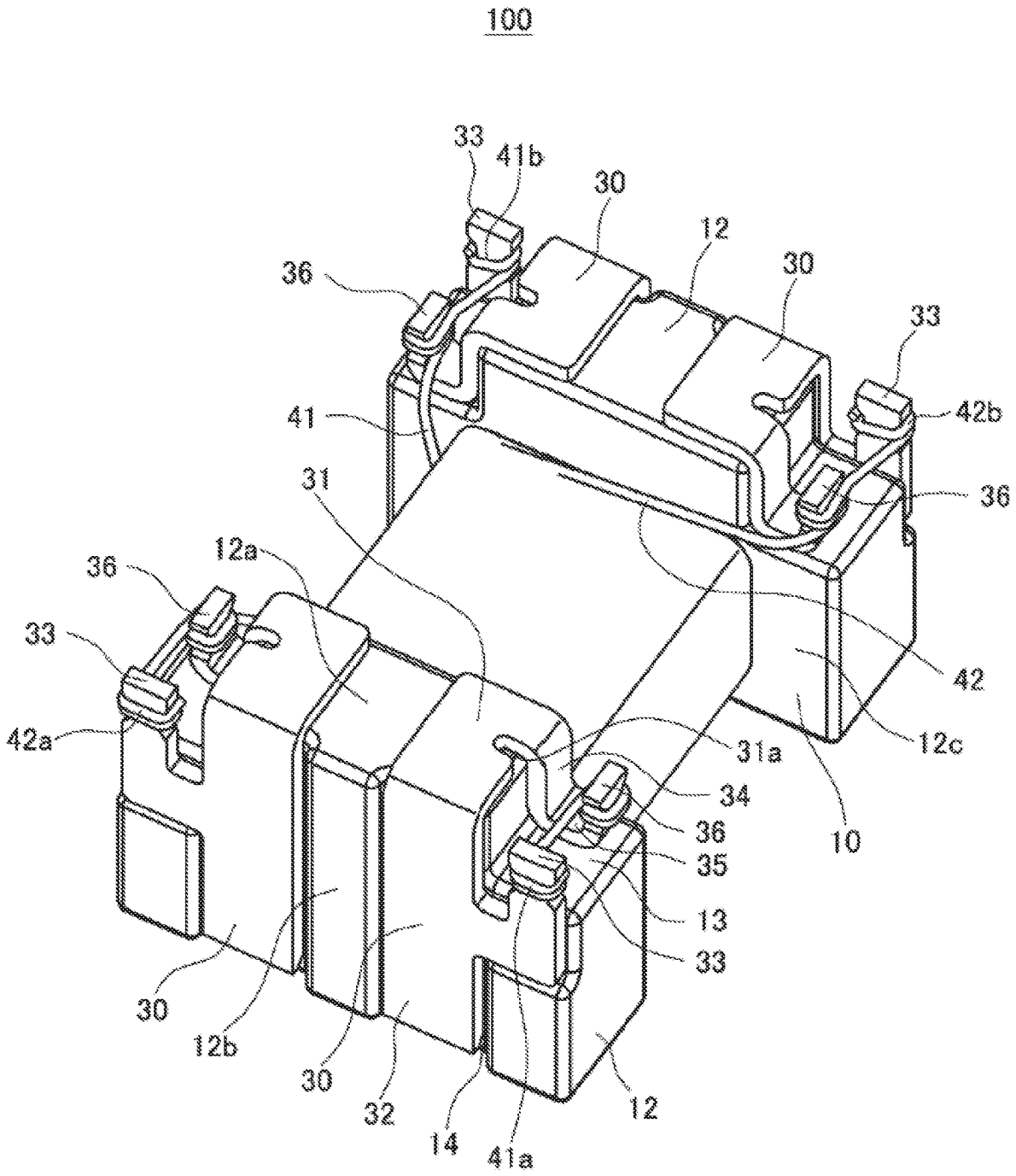
FIG. 1 is a perspective view that shows a coil component viewed from a bottom surface according to a first embodiment of the present invention. A state in which a wire end is entwined to a metal terminal is shown.

As discussed below, embodiments according to the present invention are explained with reference to the drawings. In regards to the drawings, the redundant explanations with respect to the same configurations are omitted but the same reference numerals are used for labeling.

First Embodiment

First, a first embodiment of the present invention will be explained below with reference to FIGS. 1-5.

Figure 2:
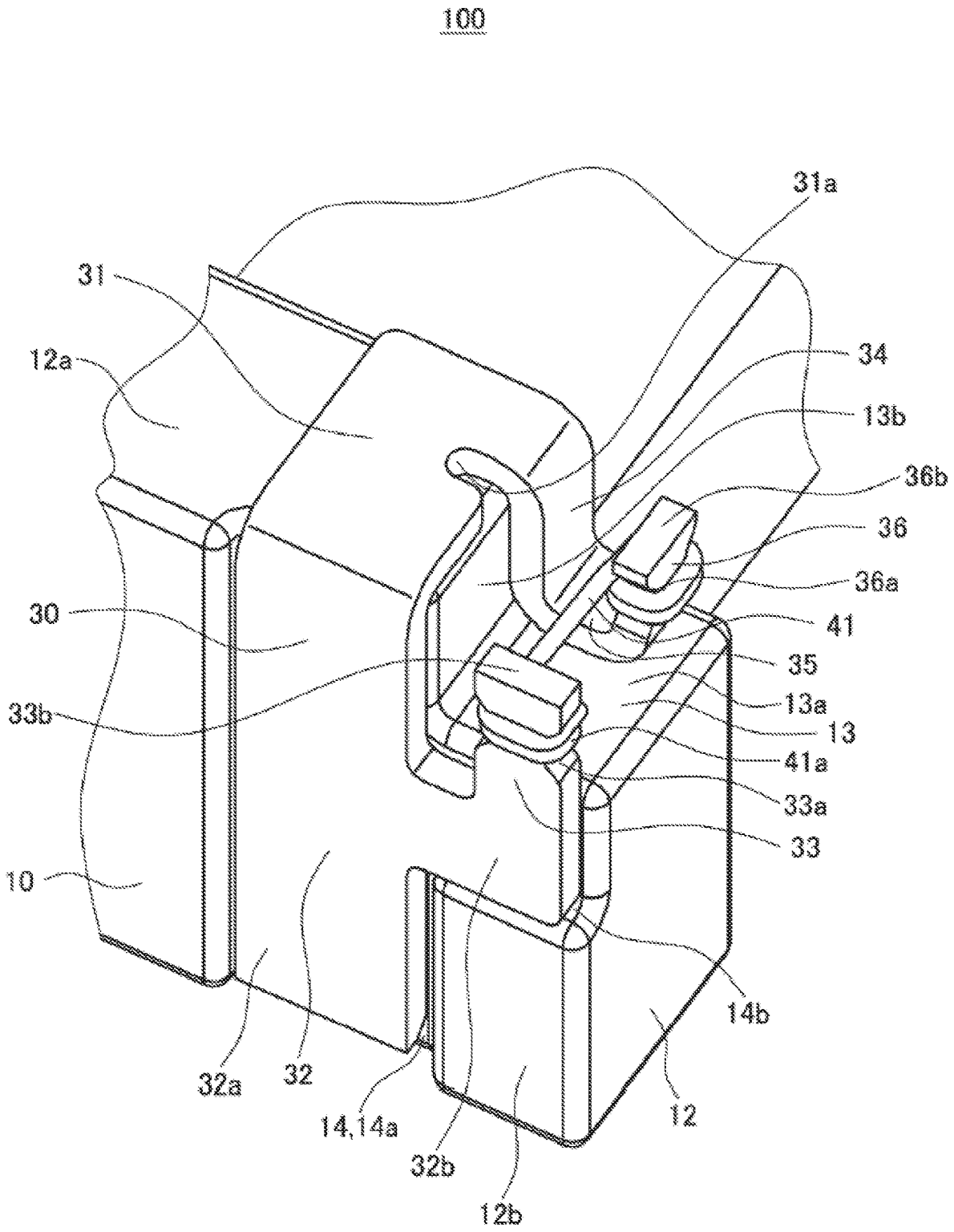
FIG. 2 is a partial enlarged perspective view of FIG. 1 according to the first embodiment of the present invention.
Figure 3:
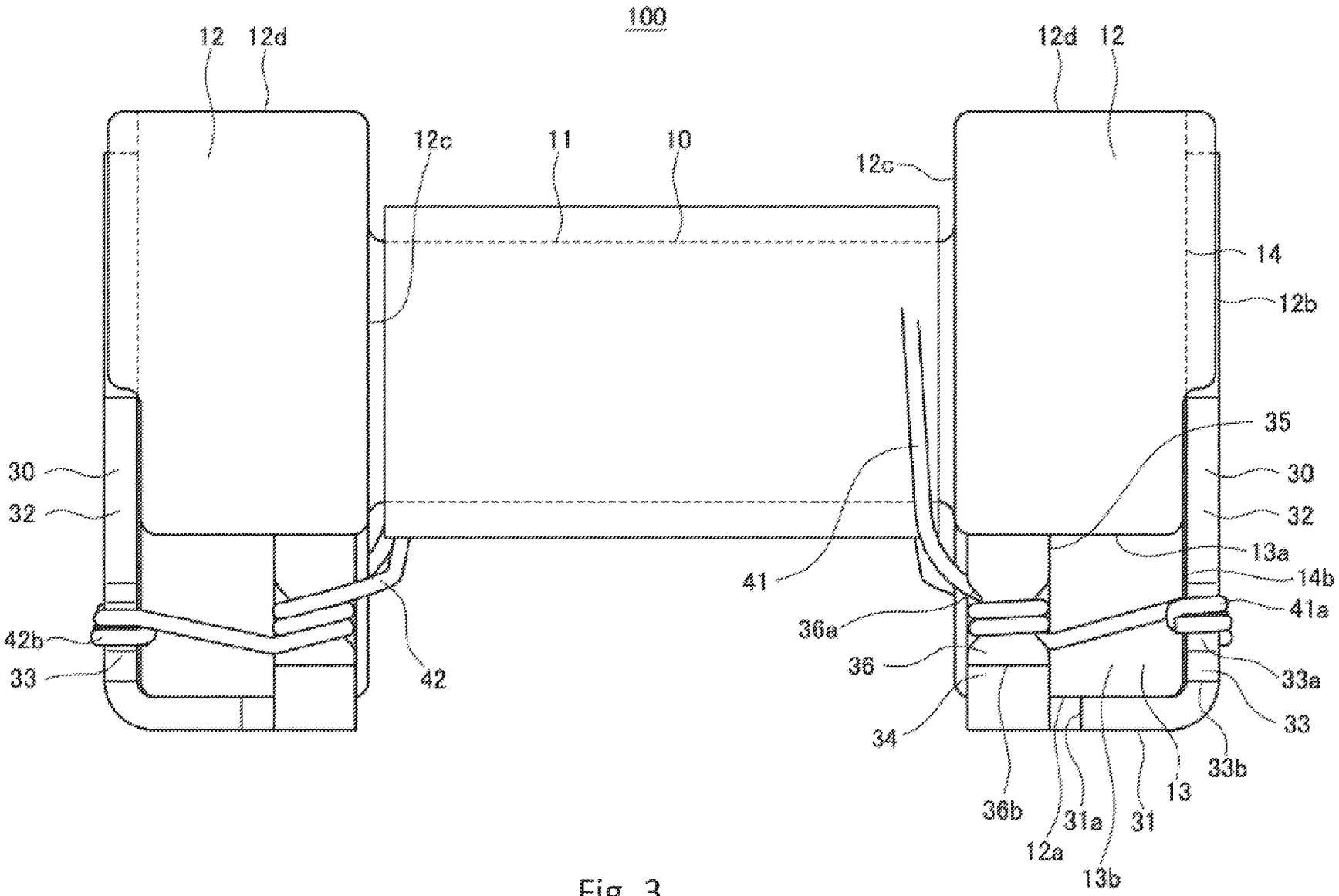
FIG. 3 is a side view that shows the coil component according to the first embodiment of the present invention. A state in which the wire end is entwined to the metal terminal is shown.

FIG. 1 is a perspective view that shows a coil component 100 viewed from a bottom surface according to a first embodiment of the present invention. FIG. 2 is a partial enlarged perspective view of FIG. 1. FIG. 3 is a side view that shows the coil component 100. Each of FIGS. 1-3 shows a state in which each corresponding wire end (one end 41*a*, the other end 41*b*, one end 42*a*, and the other end 42*b*) of wire ends is entwined to each of metal terminals 30.

Figure 4:
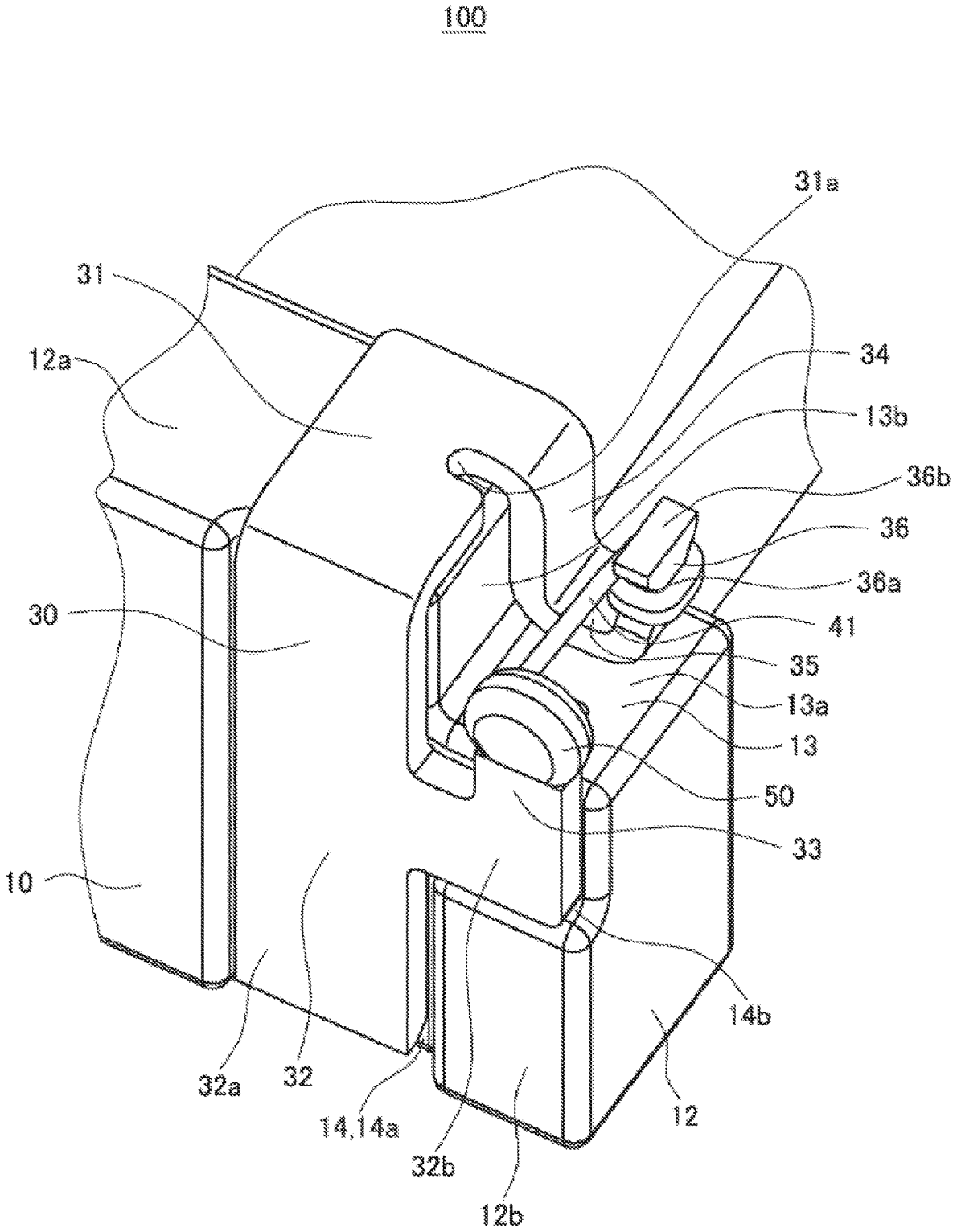
FIG. 4 is a partial enlarged perspective view that shows the coil component viewed from the bottom surface according to the first embodiment of the present invention. A state is shown after welding is conducted.

FIG. 4 is a partial enlarged perspective view that shows the coil component 100 viewed from the bottom surface and shows a state after welding is conducted.

Figure 5:
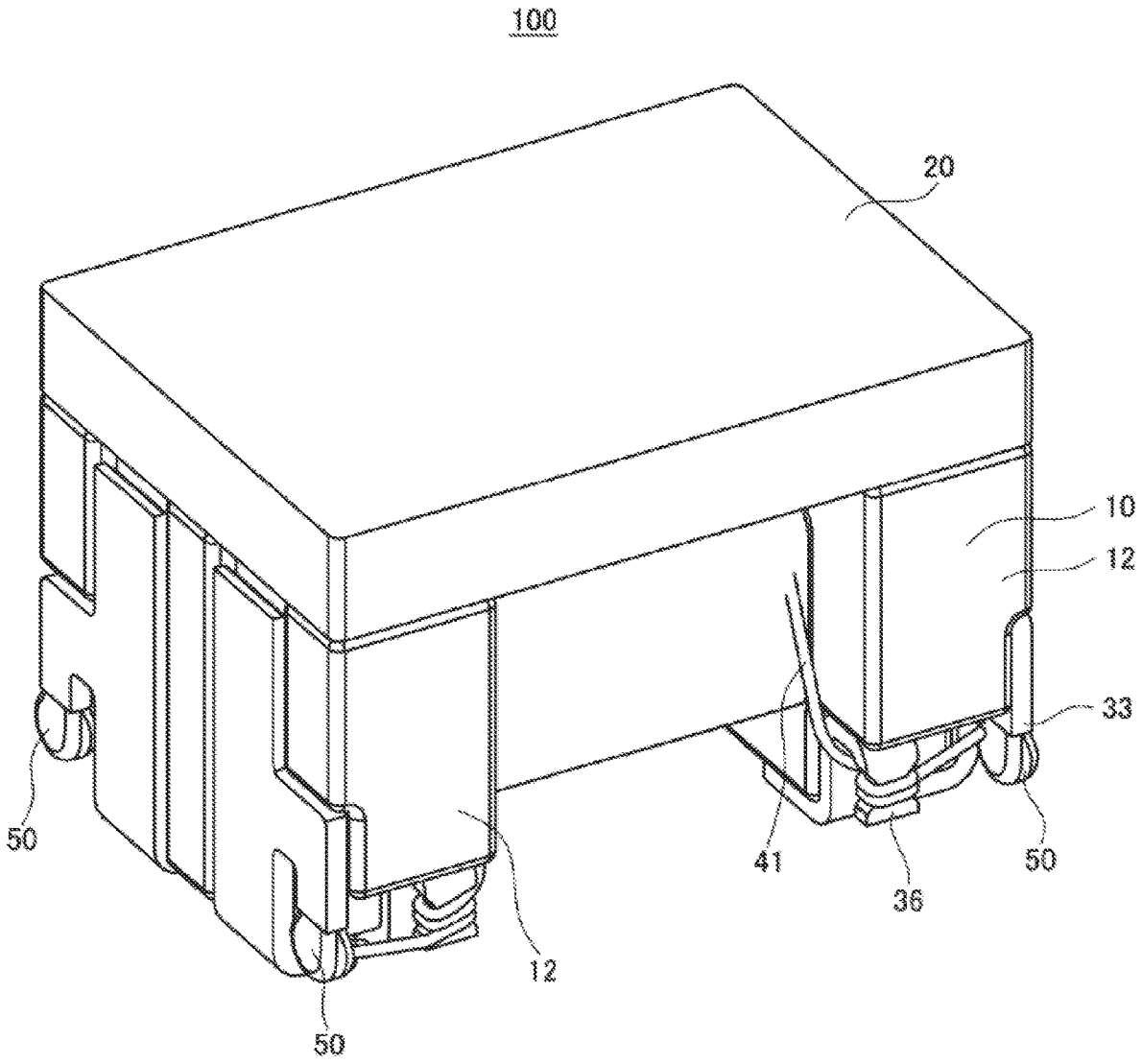
FIG. 5 is a perspective view that shows the coil component according to the first embodiment of the present invention. A state in which a plate core is provided after welding is conducted is shown.

FIG. 5 is a perspective view that shows the coil component 100 and shows a state in which a plate core 20 is provided after welding is conducted.

The coil component 100 according to the embodiment of the present invention is configured with a core (a drum core 10), first and second wires 41 and 42, and a plurality of metal terminals 30. Specifically, the drum core 10 has a shaft part (shaft) 11 (shown in FIG. 3) and flange parts (flanges) 12 that are formed on both ends of the shaft part 11, respectively. The first and second wires 41 and 42 are wound around the shaft part 11. Further, each corresponding wire end (any of one end 41*a*, the other end 41*b*, one end 42*a*, and the other end 42*b*) of both ends of the first wire 41 (one end 41*a* and the other end 41*b*) and both ends of the second wire 42 (one end 42*a* and the other end 42*b*) is connected to each of the plurality of metal terminals 30. In regards to an opposite surface (counterface) 12*a* on the flange part 12 that is provided opposed to a mounting target surface (mounting surface), a notch (cutout) shape part (notch) 13 is respectively formed at both ends in a direction of the opposite surface 12*a* of the flange parts 12. That direction is orthogonal to the axial direction of the shaft part 11. At least a part of each of the metal terminals 30 is arranged (stored) at the notch shape part 13.

The phrase "a wire end is connected to the metal terminal 30" typically means that the wire end is fixed to the metal terminal 30 by welding so that the wire end is electrically connected to the metal terminal 30 as shown in FIG. 4. However, the wire end may also be electrically connected to the metal terminal 30 by simply entwining and crimp fixation (crimping) of the wire end to the metal terminal 30.

The mounting target surface corresponds to a principal surface of an electronic board opposed to the coil component 100. The coil component 100 is mounted on, and at the same time, has an electronic connection to the electronic board.

An entirety or a part of the corresponding metal terminal 30 is provided at each of the notch shape parts 13.

Further, in the following explanations, the axial direction of the shaft part 11 (a crosswise (right and left) direction in FIG. 3) is sometimes simply referred to as "an axial direction." In addition, conveniently, a side of the mounting target surface is sometimes referred to as "a bottom (lower or below)" and an opposite side thereof is sometimes referred to as "a top (upper or above)."

Further, the coil component 100 according to the embodiment of the present invention include not only a state in which the first wire 41 and the second wire 42 are wound around the core and the wire end is connected to the metal terminal 30 by such as the welding as shown in FIGS. 4 and 5, but also a state in which the first wire 41 and the second wire 42 are not wound around the core yet (it does not have the first wire 41 and the second wire 42).

That is, another coil component 100 according to the embodiment of the present invention is configured with the core (the drum core 10) and the plurality of metal terminals 30. Specifically, the drum core 10 has the shaft part 11 and the flange parts 12 that are formed on both ends of the shaft part 11, respectively. Each corresponding wire end (any of the one end 41*a*, the other end 41*b*, the one end 42*a*, and the other end 42*b*) of both ends of each of the first wire 41 and the second wire 42, which will be respectively wound around the shaft part 11, is connected to each of the plurality of metal terminals 30. In regards to the opposite surface 12*a* on the flange part 12 that is provided opposed to the mounting target surface, the notch shape part 13 is respectively formed at both ends in the direction of the opposite surface 12*a* of the flange parts 12. That direction is orthogonal to the axial direction of the shaft part 11. At least a part of each of the metal terminals 30 is arranged at the notch shape part 13.

With respect to the coil component 100 according to the embodiment of the present invention, because at least the part of the metal terminal 30 is provided at the notch shape part 13 being formed in the flange part 12, the protrusion of the metal terminal 30 from the flange part 12 can be suppressed. As a result, the dimension of the coil component 100 in the axial direction of the shaft part 11 can be reduced (shortened).

Further, when the connection of the wire end to the metal terminal 30 is performed by utilizing the space in the notch shape part 13, the manufacturing easiness of the coil component 100 can be improved.

The more detail explanations will be provided below.

The drum core 10 is integrally structured with the shaft part 11 and the flange part 12. The drum core 10 is, for instance, a ferrite core. The shaft part 11 of the drum core 10 is, for instance, formed to be in a substantially rectangular parallelepiped shape. The flange part 12 is formed to be in a substantially rectangular parallelepiped shape and is thin and flat in the axial direction.

Each of the flange parts 12 has an inner surface 12*c* being opposed to the other flange part 12, an outer surface 12*b* facing toward an opposite side of the inner surface 12, and a reverse surface 12*d* facing toward an opposite side of the opposite surface 12*a* (shown in FIG. 3) in addition to the opposite surface 12*a* that is provided opposed to the mounting target surface. The opposite surface 12*a* is a lower side surface (a bottom surface) of the flange part 12 and the reverse surface 12*d* is an upper side surface (a top surface) of the flange part 12.

As shown in FIG. 1, two of the notch shape parts 13 are formed in each of a pair of flange parts 12. Thus, the coil component 100 has four of the notch shape parts 13 in total. Each of the notch shape parts 13 is a recessed part (recess) that is in a substantially rectangular parallelepiped shape.

The notch shape part 13 is shaped by upwardly notching (cutting) the flange 12 from the opposite surface 12*a*.

As shown in FIGS. 2 and 4, the notch shape part 13 has a raised (elected) surface 13*b* and a notch opposite surface (opposing surface) 13*a*. Specifically, the raised surface 13*b* is parallel to the axial direction and is orthogonal to the opposite surface 12*a*. The notch opposite surface 13*a* is provided opposite to the mounting target surface. Further, the notch opposite surface 13*a* is parallel to the opposite surface 12*a*.

Each of the notch shape part 13 is formed extending over both ends of each of the flange parts 12 in the axial direction and is open to both sides in the axial direction.

Further, in the following explanations, conveniently, an arrangement direction of two of the notch shape parts 13 that is formed in each flange part 12 is sometimes referred to as "a crosswise (right and left) direction." That is, a pair of left and right notch shape parts 13 are formed in each of the flange parts 12.

A flat recessed part (recess) 14 is formed in the outer surface 12*b* of the flange part 12 and is inwardly recessed toward inside in the axial direction. In the present embodiment, the recessed part 14 is in a toppled T-shape. The recessed part 14 is configured with a vertical direction extension part 14*a* and a horizontal direction extension part 14*b*. Specifically, the vertical direction extension part 14*a* extends from the opposite surface 12*a* through the reverse surface 12*d* in a band-like shape in a vertical direction (a longitudinal direction). The horizontal direction extension part 14*b* extends from the vertical direction extension part 14*a* in a direction (a left direction or a right direction) orthogonal to an extending direction of the vertical direction extension part 14*a*.

A pair of left and right recessed parts 14 are formed on each of the outer surfaces 12*b*. The pair of recessed parts 14 are left-right symmetrically provided. A rib that extends from the opposite surface 12*a* through the reverse surface 12*d* in a band-like shape in the vertical direction exists between the pair of recessed parts 14.

A direction in which the horizontal direction extension part 14*b* extends from the vertical direction extension part 14*a* of the left recessed part 14 is a left direction. Further, a direction in which the horizontal direction extension part 14*b* extends from the vertical direction extension part 14*a* of the right recessed part 14 is a right direction.

An upper end of the left horizontal direction extension part 14*b* is adjacent to and connected to the left notch opposite surface 13*a*. An upper end of the right horizontal direction extension part 14*b* is adjacent to and connected to the right notch opposite surface 13*a*.

In regards to the left vertical direction extension part 14*a*, a left end of an upper portion, which is located upper than the horizontal direction extension part 14*b*, is adjacent to and connected to the left raised surface 13*b*. In regards to the right vertical direction extension part 14*a*, a right end of an upper portion that is locate upper than the horizontal direction extension part 14*b* is adjacent to and connected to the right raised surface 13*b*.

As shown in FIGS. 2 and 4, the metal terminal 30 is configured with a bottom plate 31, a raised part (raised segment) 34, a notch opposite surface arrangement section (arrangement plate) 35, and an entwining part (entwining tab) 36. Specifically, the bottom plate 31 is provided along the opposite surface 12*a* of the flange part 12. The raised part 34 rises from the bottom plate 31 along the raised surface 13*b* of the notch shape part 13. The notch opposite surface arrangement section 35 extends from the raised part 34 along the notch opposite surfaces 13*a* of the notch shape part 13. The entwining part 36 rises from the notch opposite surface arrangement section 35 and is provided opposite to the raised part 34. Further, the wire end (one end 41*a* of the first wire 41 in FIGS. 2 and 4) is entwined to the entwining part 36.

In addition, the metal terminal 30 has a flat base part (external plate) 32 and a weld part (weld tab) 33. Specifically, the flat base part 32 is provided in the recessed part 14 and is orthogonal to the axial direction. The weld part 33 rises from the flat base part 32 toward a side of the mounting target surface.

The metal terminal 30 is, for instance, manufactured by punching (blanking) and bending methods for a conductive metal plate. Therefore, each part of the metal terminals 30 is formed in a plate-like shape.

The entirety of the flat base part 32 is formed in a flat plate shape. The flat base part 32 is formed in the same shape as the recessed part 14. That is, the flat base part 32 is configured with a vertical direction extension part 32*a* that has the same shape as the vertical direction extension part 14*a* and a horizontal direction extension part 32*b* that has the same shape as the horizontal direction extension part 14*b*. The vertical direction extension part 32*a* is provided in the vertical direction extension part 14*a* and the horizontal direction extension part 32*b* is provided in the horizontal direction extension part 14*b*.

The weld part 33 is provided on the same plane as the flat base part 32. The weld part 33 upwardly rises from the tip part of the horizontal direction extension part 32*b* toward a side of the mounting target surface. The weld part 33 is separated from the vertical direction extension part 32*a*. The weld part 33 is provided at a position that is adjacent to an external side in the axial direction relative to the notch shape part 13. Further, the weld part 33 is provided at the external side in the axial direction with respect to the entwining part 36.

A constricted part 33*a* is formed in the weld part 33. The constricted part 33*a* is more constricted as compared with other areas around the constricted part 33*a* in the weld part 33 (a width of the constricted part 33*a* is narrower in the right and left direction than others).

After the first wire 41 and the second wire 42 are wound around the shaft part 11, the wire end (for example, one end 41*a*) is entwined to the constricted part 33*a* as shown in FIG. 2.

Because the wire end is entwined to the constricted part 33*a* in the weld part 33, it can be suppressed that the wire end being entwined to the weld part 33 is detached from the weld part 33.

The bottom plate 31 is bent substantially perpendicularly to the flat base part 32. The bottom plate 31 is, for instance, formed in a substantially rectangular shape. The bottom plate 31 is provided on the opposite surface 12*a* at a position that is adjacent to the raised surface 13*b*. The bottom plate 31 is, for instance, provided on an entire area between both ends of the opposite surface 12*a* in the axial direction.

The left raised part 34 is continuously connected to the left end of the left bottom plate 31 and is bent substantially perpendicularly to this bottom plate 31. The right raised part 34 is continuously connected to the right end of the right bottom plate 31 and is bent substantially perpendicularly to this bottom plate 31. Further, specifically, each of the raised parts 34 is continuously connected to the inner side portion with respect to the axial direction at each of the bottom plates 31.

"The raised part 34 rises from the bottom plate 31 along the raised surface 13*b*" means that the raised part 34 upwardly rises from the bottom plate 31, and at the same time, the raised part 34 is provided along the raised surface 13*b*.

Each of the notch opposite surface arrangement sections 35 is continuously connected to the upper end of each of the raised parts 34 and is bent substantially perpendicularly to each of the raised parts 34.

The left notch opposite surface arrangement section 35 extends from the raised part 34 to the left side and is provided along the left notch opposite surfaces 13*a*. The right notch opposite surface arrangement section 35 extends from the raised part 34 to the right side and is provided along the right notch opposite surfaces 13*a*.

The left entwining part 36 is continuously connected to the left end of the left notch opposite surface arrangement section 35 and is bent substantially perpendicularly to this notch opposite surface arrangement section 35. The right entwining part 36 is continuously connected to the right end of the right notch opposite surface arrangement section 35 and is bent substantially perpendicularly to this notch opposite surface arrangement section 35.

Each of the entwining parts 36 downwardly extends from the notch opposite surface arrangement section 35.

The constricted part 36*a* is formed in the entwining part 36. The constricted part 36*a* is more constricted as compared with other areas around the constricted part 36*a* in the entwining part 36 (a width of the constricted part 36*a* is narrower in the axial direction than others).

After the first wire 41 and the second wire 42 are wound around the shaft part 11, as shown in FIG. 2, the wire end (one end 41*a*, for example) is entwined to the constricted part 36*a*.

Because the wire end is entwined to the constricted part 36*a* in the entwining part 36, it can be suppressed that the wire end being entwined to the entwining part 36 is detached from the entwining part 36.

In the present embodiment, the entirety of each of the entwining parts 36 is provided at each of the notch shape parts 13. More specifically, in regards to each of the metal terminals 30, the raised part 34, the notch opposite surface arrangement section 35, and the entirety of the entwining part 36 are provided at each of the notch shape parts 13.

The raised part 34, the notch opposite surface arrangement section 35, and the entwining part 36 are provided at the inner side portion with respect to the axial direction at the notch shape part 13.

In each of the notch shape parts 13, the part including the raised part 34, the notch opposite surface arrangement section 35, and the entwining part 36 is configured by bending a band-shaped metal piece.

For instance, with respect to the left end of the left bottom plate 31, a cut part 31*a* is formed at a position corresponding to a connection part at which the left raised part 34 and the left bottom plate 31 are connected. Further, with respect to the right end of the right bottom plate 31, the cut part 31*a* is formed at a position corresponding to a connection part at which the right raised part 34 and the right bottom plate 31 are connected.

As shown in FIG. 3, for instance, a tip 33*b* of the weld part 33 is located above the bottom plate 31, and more specifically, is located above the opposite surface 12*a*.

Further, a tip 36*b* of the entwining part 36 is also located above the bottom plate 31, and more specifically, is located above the opposite surface 12*a*.

However, the tip 33*b* is, for instance, located below the tip 36*b*.

The metal terminal 30 is attached to and fixed on the flange part 12 by, for instance, an adhesive.

As shown in FIG. 5, the coil component 100 has further a plate core 20 being provided at the drum core 10. The plate core 20 is, for instance, formed in a rectangular and flat plate shape. The plate core 20 is installed between the reverse surfaces 12*d* (refer to FIG. 3) of the pair of the flange parts 12. The plate core 20 is also, for instance, a ferrite core.

As explained above, in the present embodiment, the metal terminal 30 is configured with the entwining part 36 to which the wire end is entwined and the weld part 33 to which the wire end is welded. The entwining part 36 is provided at the notch shape part 13.

Because the entwining part 36 is provided at the notch shape part 13, the protrusion of the metal terminal 30 from the flange part 12 can be suppressed. As a result, the dimension of the coil component 100 in the axial direction of the shaft part 11 can be reduced (shortened). Further, the wire end can be easily entwined to the entwining part 36 by utilizing the space in the notch shape part 13. In addition, because the metal terminal 30 has the entwining part 36 and the weld part 33, the wire end can be more stably connected to the metal terminal 30.

Further, the wire end between the entwining part 36 and the weld part 33 is a so-called aerial wiring. However, because the wire end is also entwined to the weld part 33 after being entwined to the entwining part 36, the tension of the wire end between the entwining part 36 and the weld part 33 can be reduced. In other words, the tension of the wire end can be dispersed to the entwining part 36 and the weld part 33. As a result, the damage and the disconnection (breaking) of the wire end such as at the time of the welding can be suppressed.

Further, on a surface (the outer surface 12*b*) of the external side in the axial direction of the flange parts 12, the flat recessed part 14, which is inwardly recessed toward the inside in the axial direction, is formed. The metal terminal 30 has the flat base part 32 that is provided at the recessed part 14 and that is orthogonal to the axial direction. The weld part 33 downwardly rises from the flat base part 32 toward a side of the mounting target surface and is provided at a position that is adjacent to the external side in the axial direction relative to the notch shape part 13.

Because the flat base part 32 of the metal terminal 30 is provided at the recessed part 14, the protrusion of the metal terminal 30 from the flange part 12 can be suppressed. As a result, the dimension of the coil component 100 in the axial direction of the shaft part 11 can be reduced (shortened). Further, because the weld part 33 is provided at a position that is adjacent to the external side in the axial direction relative to the notch shape part 13, the wire end is easily routed to the weld part 33 and the wire end can be welded to this weld part 33 after the wire end is entwined to the entwining part 36 that is provided at the notch shape part 13.

The coil component 100 is, for instance, a common mode choke coil.

Next, an example of the procedure to manufacture the coil component 100 will be explained below.

First, as shown in FIGS. 1-3, the first wire 41 and the second wire 42 are wound around the shaft part 11 (refer to FIG. 3). The one end 41*a* and the other end 41*b* of the first wire 41 and the one end 42*a* and the other end 42*b* of the second wire 42 are sequentially entwined to the entwining part 36 and the weld part 33 of the corresponding metal terminal 30.

For instance, the one end 41*a* and the other end 41*b* of the first wire 41 are respectively entwined to two of the metal terminals 30 that is obliquely opposed to each other. Further, the one end 42*a* and the other end 42*b* of the second wire 42 are respectively entwined to remaining two of the metal terminals 30.

Further, in regards to each of the wire ends (the one end 41*a*, the other end 41*b*, the one end 42*a*, and the other end 42*b*), the part of the tip side beyond the portion that is entwined to each of the weld parts 33 is held by an external jig (not shown).

Next, by irradiating a laser beam to each of the weld parts 33, the weld part 33 and each of the wire ends (the one end 41*a*, the other end 41*b*, the one end 42*a* and the other end 42*b*) are welded. As a result, the tip part of the weld part 33 (for instance, the part of the tip side beyond the constricted part 33*a*) and the wire end that is entwined to the weld part 33 are melted and integrated so that a weld ball 50 (shown in FIG. 4) is formed. An irradiation direction of the laser beam is, for instance, an upward direction from below.

As explained above, each of the wire ends is welded and is electrically respectively connected to the corresponding metal terminal 30.

Next, the plate core 20 is installed between the reverse surfaces 12*d* (refer to FIG. 3) of the pair of the flange parts 12. The plate core 20 is attached to and fixed on the flange parts 12 by, for instance, an adhesive. As a result, the coil component 100 (shown in FIG. 5) that has the drum core 10 and the plate core 20 can be obtained.

Second Embodiment

Next, a second embodiment of the present invention will be explained below with reference to FIGS. 6-9.

Figure 6:
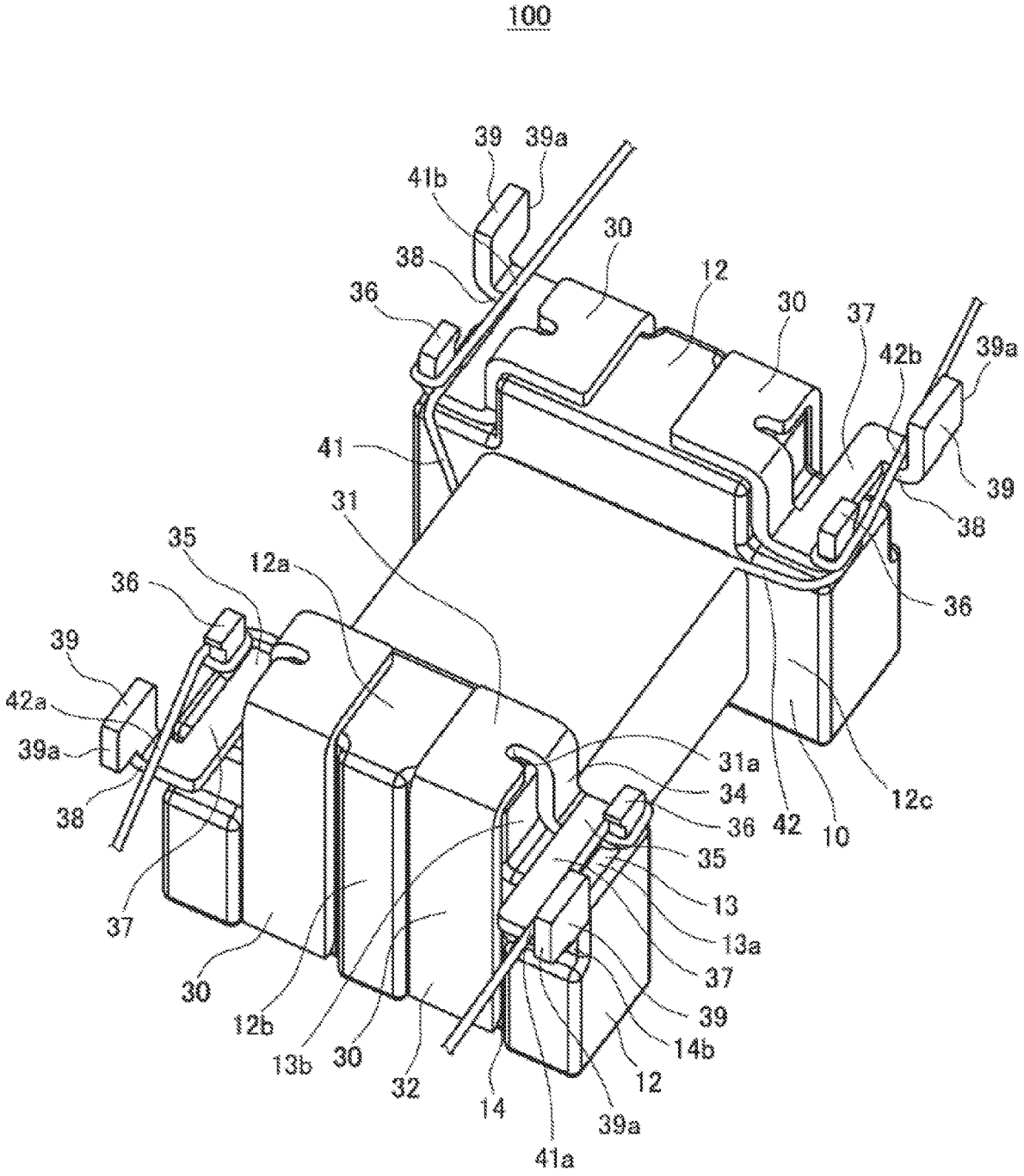
FIG. 6 is a perspective view that shows a coil component viewed from a bottom surface according to a second embodiment of the present invention. A state in which a wire end is provided on a metal terminal is shown.
Figure 7:
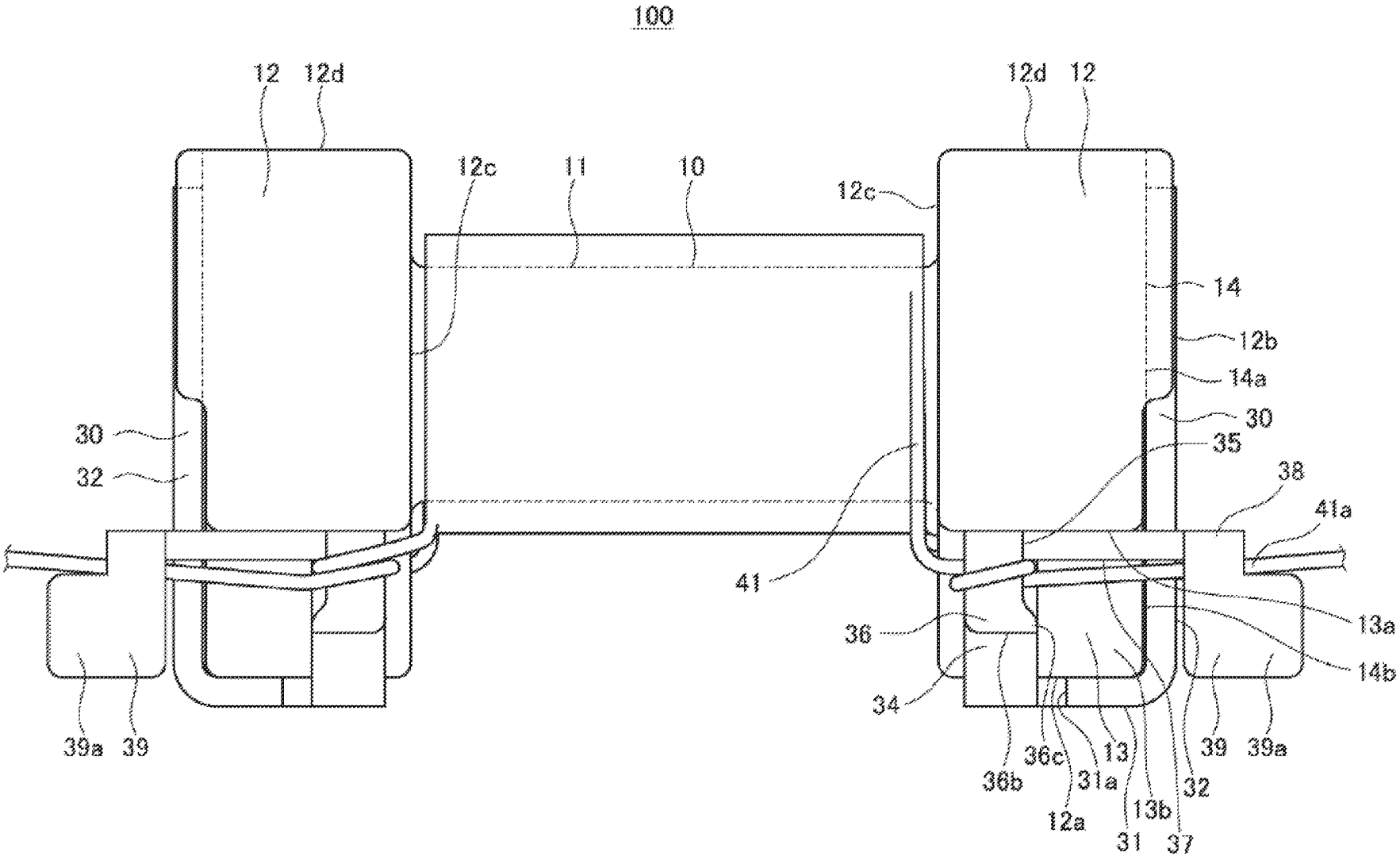
FIG. 7 is a side view that shows the coil component according to the second embodiment of the present invention. A state in which the wire end is provided on the metal terminal is shown.
Figure 8:
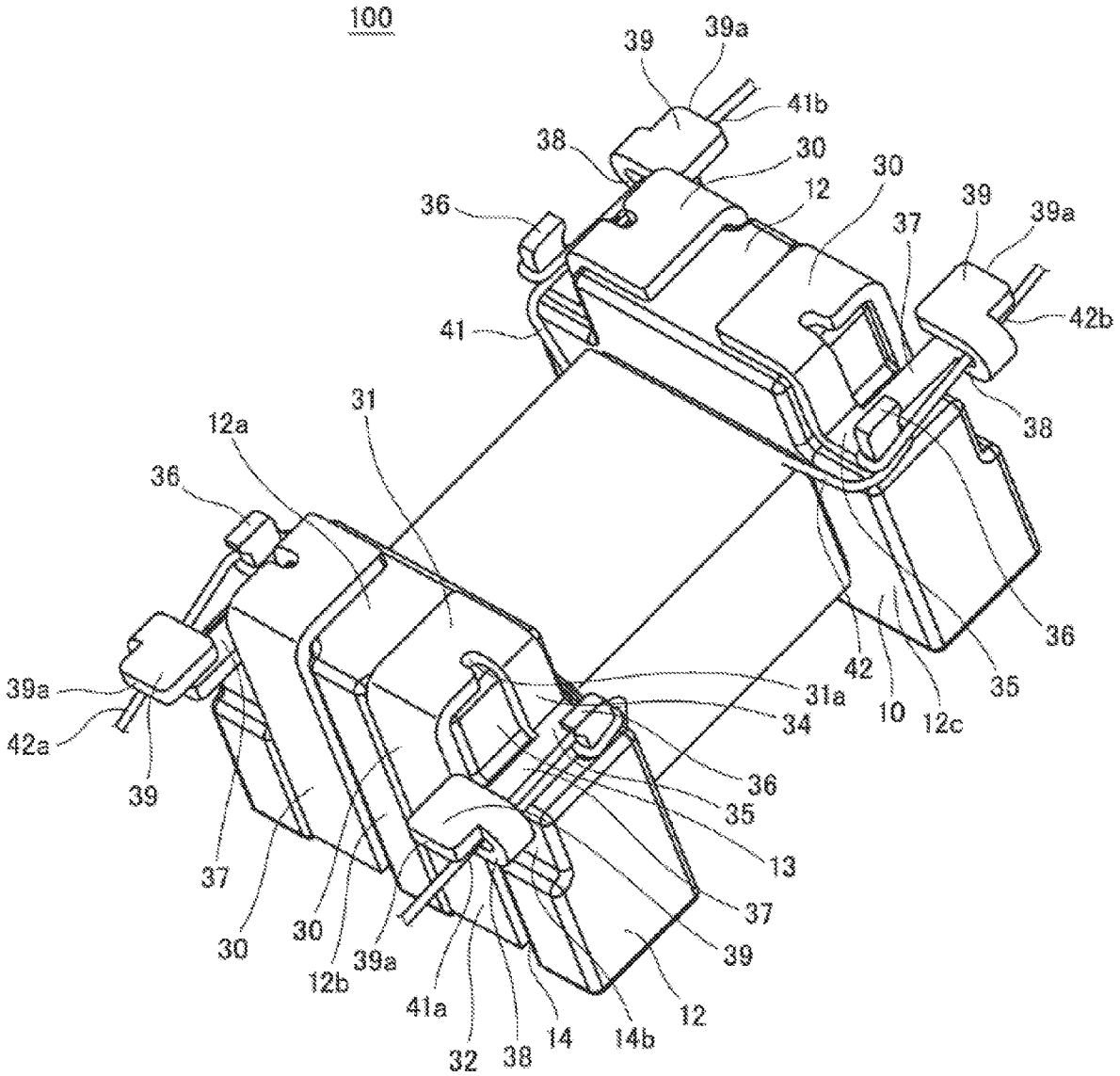
FIG. 8 is a perspective view that shows the coil component viewed from the bottom surface according to the second embodiment of the present invention. A state in which the wire end is crimped and fixed is shown.
Figure 9:
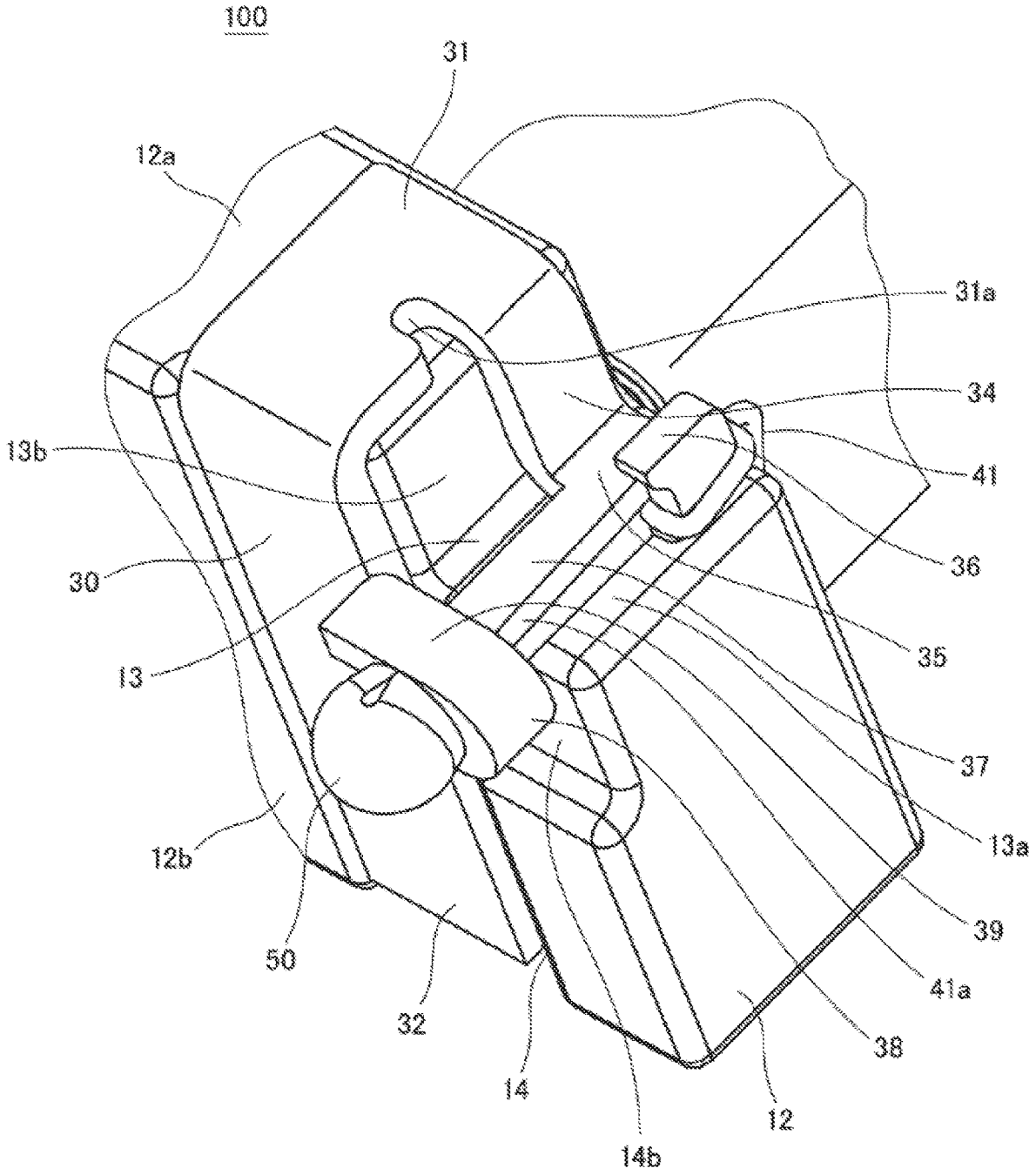
FIG. 9 is a partial enlarged perspective view that shows the coil component viewed from the bottom surface according to the second embodiment of the present invention. A state is shown after welding is conducted.

FIG. 6 is a perspective view that shows the coil component 100 viewed from a bottom surface according to the second embodiment of the present invention. FIG. 7 is a side view that shows the coil component 100 according to the second embodiment of the present invention. FIGS. 6 and 7 show the states in which the wire ends are provided at the metal terminals 30. FIG. 8 is a perspective view that shows the coil component 100 viewed from the bottom surface according to the second embodiment of the present invention. FIG. 8 shows a state in which the wire ends are crimped and fixed. FIG. 9 is a partial enlarged perspective view that shows the coil component 100 viewed from the bottom surface according to the second embodiment of the present invention. FIG. 9 shows a state in which the welding is already performed.

The coil component 100 according to the present embodiment is different from the coil component 100 according to the first embodiment explained above with respect to the configuration of the metal terminal 30. In other respects (configurations), the coil component 100 according to the present embodiment is configured in the same way as the coil component 100 according to the first embodiment explained above.

In the present embodiment, the metal terminal 30 does not have the horizontal direction extension part 32*b* and the weld part 33 (shown in FIG. 2). That is, the flat base part 32 is configured by the vertical direction extension part 32*a* explained in the first embodiment.

Instead, the metal terminal 30 has an axial direction extension part (axial direction extension plate) 37 (shown in FIG. 9, etc.), an outer extension part 38 (shown in FIG. 6, etc.), and a crimp piece (crimp tip) 39 (shown in FIG. 9, etc.).

As shown in, for example, FIG. 6, the axial direction extension part 37 outwardly extends from the notch opposite surface arrangement section 35 to the external side in the axial direction. More specifically, for instance, the axial direction extension part 37 has a part that is provided along the notch opposite surfaces 13*a* and a part that projects from such part to the external side in the axial direction (i.e., a part that projects from the flange part 12 to the external side in the axial direction). The axial direction extension part 37 is provided on the same plane as the notch opposite surface arrangement section 35.

The outer extension part 38 laterally extends from a projection part of the axial direction extension part 37 that projects from the flange part 12 to the external side in the axial direction. The left outer extension part 38 extends from the left axial direction extension part 37 to the left side and the right outer extension part 38 extends from the right axial direction extension part 37 to the right side.

The crimp piece 39 is continuously connected to a tip part in an extending direction of the outer extension part 38.

The crimp piece 39 is the part in which the wire end is crimped and fixed, and is welded. After the wire end is crimped and fixed by the crimp piece 39, the wire end is welded to the crimp piece 39.

As shown in FIGS. 6 and 7, in a state in which the crimp fixation of the wire end by utilizing the crimp piece 39 is not performed yet, the crimp piece 39 is in the state in which the crimp piece 39 downwardly rises from the tip part of the outer extension part 38 in the extending direction. In this state, the crimp piece 39 is, for instance, bent substantially perpendicularly to the axial direction extension part 37 and the outer extension part 38. In this state, the crimp piece 39 has, for instance, a weld piece 39*a* that projects to the external side in the axial direction than the axial direction extension part 37 and the outer extension part 38. Further, in this state, an angle formed between the crimp piece 39 and the axial direction extension part 37 and the outer extension part 38 can be greater than 90 degrees. It is more preferable that the angle is 100 degrees or greater.

The crimp piece 39 is, for instance, formed in a substantially rectangular shape.

As shown in FIG. 8, in a state in which the crimp fixation of the wire end by utilizing the crimp piece 39 is already performed, the crimp piece 39 is in a folded-back shape that is obtained by being folded back from the axial direction extension part 37 (via the outer extension part 38). That is, the crimp piece 39 and the axial direction extension part 37 are opposed to each other while sandwiching the wire end. As a result, the wire end is crimped and fixed by being held by the crimp piece 39, and the outer extension part 38 or the axial direction extension part 37.

As explained above, the crimp piece 39 is in the folded-back shape that is obtained by being folded back from the edge of the axial direction extension part 37 in the direction orthogonal to the axial direction, and as a result, the wire end is crimped and fixed.

The left crimp piece 39 is folded back from the left edge at the tip part (the end of the external side in the axial direction) of the axial direction extension part 37. The right crimp piece 39 is folded back from the right edge at the tip part (the end of the external side in the axial direction) of the axial direction extension part 37.

As shown in FIG. 9, in a state in which the welding is already performed, a part (for instance, the weld piece 39*a*) of the crimp piece 39 is melted and integrated with the wire end. As a result, a weld ball 50 is formed.

Note that a tip part of the axial direction extension part 37 together with the crimp piece 39 (for instance, the weld piece 39*a*) can also be melted and integrated with the wire end by the welding. Further, a part of the outer extension part 38 can also be melted and integrated with the wire end by the welding.

In the present embodiment, the tip part of the external side in the axial direction of at least one of the crimp piece 39 and the axial direction extension part 37 is the weld portion.

However, the present invention is not limited to the above features. Specifically, the tip part of the axial direction extension part 37, not the crimp piece 39, can also be melted and integrated with the wire end by the welding.

Further, in the first embodiment explained above, the entwining part 36 has the constricted part 36*a* (shown in FIG. 3, etc.). On the other hand, in the present embodiment, the entwining part 36 does not have the constricted part 36*a* and the tip part (the end part) of the entwining part 36 has a projection 36*c* that projects to the external side in the axial direction. As a result, it is suppressed that the wire end being entwined to the entwining part 36 is detached from the entwining part 36.

As explained above, the notch shape part 13 has the raised surface 13*b* and the notch opposite surfaces 13*a*. Specifically, the raised surface 13*b* is parallel to the axial direction and is orthogonal to the opposite surface 12*a*. The notch opposite surfaces 13*a* is provided opposed to the mounting target surface. The metal terminal 30 has the bottom plate 31, the raised part 34, the notch opposite surface arrangement section 35, the entwining part 36, the axial direction extension part 37, and the crimp piece 39. Specifically, the bottom plate 31 is provided along the opposite surface 12*a* of the flange part 12. The raised part 34 rises from the bottom plate 31 along the raised surface 13*b* of the notch shape part 13. The notch opposite surface arrangement section 35 extends from the raised part 34 along the notch opposite surfaces 13*a* of the notch shape part 13. The entwining part 36 rises from the notch opposite surface arrangement section 35 and is provided opposite to the raised part 34. Further, the wire end is entwined to the entwining part 36. The axial direction extension part 37 extends from the notch opposite surface arrangement section 35 in the axial direction. The crimp piece 39 is in the folded-back shape that is obtained by being folded back from the axial direction extension part 37 so that the wire end is crimped and fixed by the crimp piece 39. The entwining part 36 is provided at the notch shape part 13, and the wire end is welded to the tip part of the external side in the axial direction of at least one of the crimp piece 39 and the axial direction extension part 37.

Thus, after the wire end is entwined to the entwining part 36, and furthermore, after the wire end is crimped and fixed by the crimp piece 39, the wire end can be welded. Therefore, the welding of the wire end can be stably performed.

Further, because the wire end is crimped and fixed by the crimp piece 39 after the wire end is entwined to the entwining part 36, the tension of the wire end between the entwining part 36 and the crimp piece 39 can be reduced. In other words, the tension of the wire end can be dispersed to the entwining part 36 and the crimp piece 39. As a result, the damage and the disconnection (breaking) of the wire end such as at the time of the welding can be suppressed.

In the present embodiment, the wire end can be connected to the metal terminal 30 by the welding in a state in which the wire end is entwined to the entwining part 36, and furthermore, is crimped and fixed by the crimp piece 39. Therefore, the wire end can be more stably connected to the metal terminal 30.

Further, as shown in FIG. 7, the crimp piece 39 is provided at the external side in the axial direction than the portion (the horizontal direction extension part 14*b*) that is adjacent to the notch opposite surfaces 13*a* on the surface (the outer surface 12*b*) of the flange part 12 at the external side in the axial direction.

Therefore, the work in which the wire end is crimped and fixed by bending the crimp piece 39 can be easily performed without the interference of such as the flange part 12.

More specifically, the crimp piece 39 is, for instance, provided at the external side in the axial direction than the flat base part 32.

Further, though an illustration is omitted from the drawings, even in the present embodiment, the coil component 100 has the plate core 20 (refer to FIG. 5).

Next, an example of the procedure to manufacture the coil component 100 according to the present embodiment will be explained below.

First, as shown in FIGS. 6 and 7, the first wire 41 and the second wire 42 are wound around the shaft part 11. The one end 41*a* and the other end 41*b* of the first wire 41 and the one end 42*a* and the other end 42*b* of the second wire 42 are entwined to the corresponding entwining part 36 of the corresponding metal terminal 30 and are arranged along the outer extension part 38 or the axial direction extension part 37.

Further, in regards to each of the wire ends (the one end 41*a*, the other end 41*b*, the one end 42*a*, and the other end 42*b*), the part of the tip side beyond the portion that is provided along the outer extension part 38 or the axial direction extension part 37 is held by an external jig (not shown).

Next, as shown in FIG. 8, each of the crimp pieces 39 is bent toward the axial direction extension part 37 (via the outer extension part 38) and each of the wire ends is crimped and fixed.

Next, for instance, by irradiating a laser beam to the weld piece 39*a* of each of the metal terminals 30, the weld piece 39*a* and each of the wire ends (the one end 41*a*, the other end 41*b*, the one end 42*a*, and the other end 42*b*) are welded. As a result, the weld ball (shown in FIG. 9) is formed. The irradiation direction of the laser beam is, for instance, the upward direction from below. As explained above, each of the wire ends is welded to and is electrically connected to the corresponding metal terminal 30.

Thereafter, in the same way as the first embodiment, the plate core 20 is fixed to the drum core 10. As a result, the coil component 100 that has the drum core 10 and the plate core 20 can be obtained.

Third Embodiment

Next, a third embodiment of the present invention will be explained below with reference to FIGS. 10-15.

Figure 10:
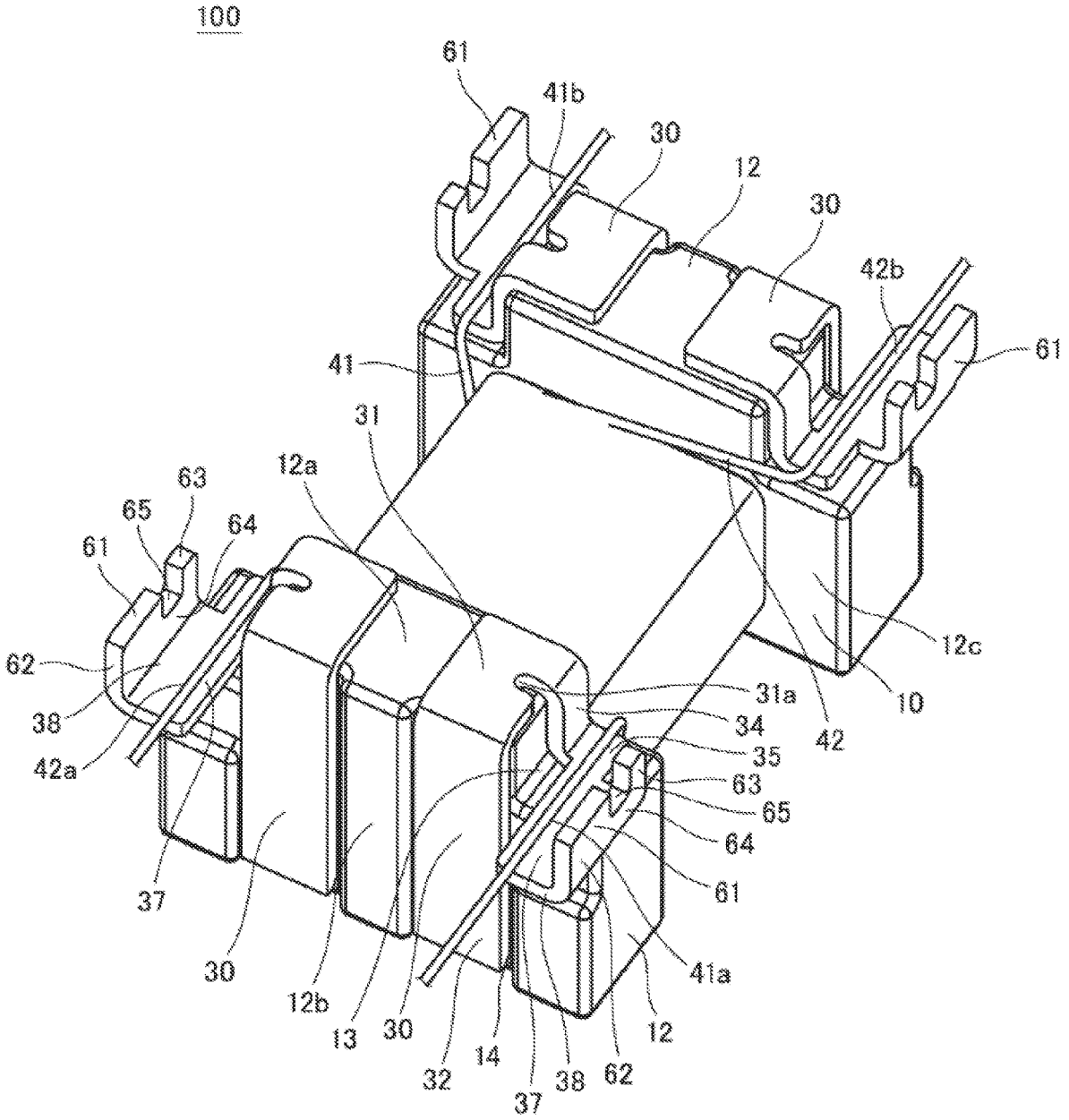
FIG. 10 is a perspective view that shows a coil component viewed from a bottom surface according to a third embodiment of the present invention. A state in which a wire end is provided on a metal terminal is shown.
Figure 11:
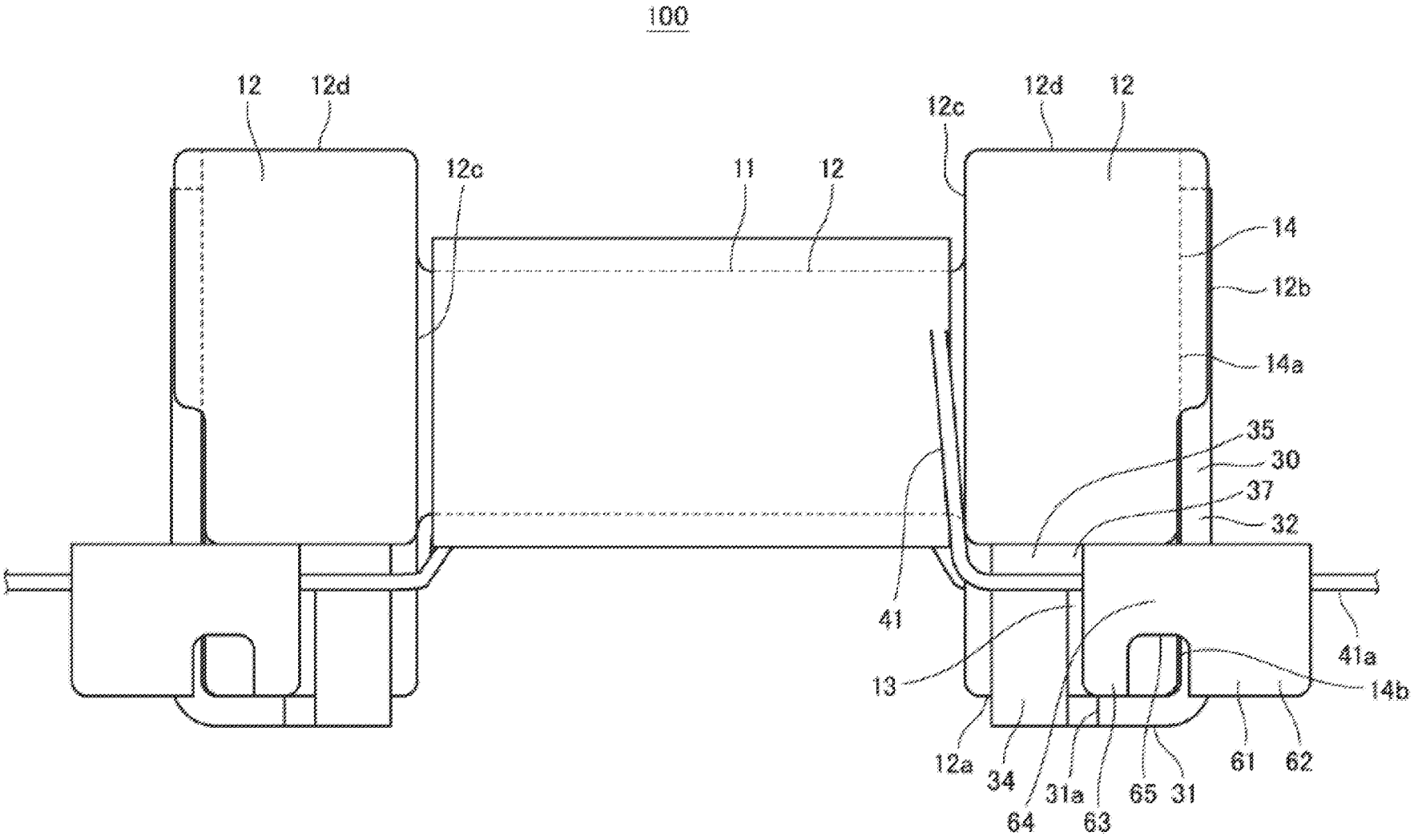
FIG. 11 is a side view that shows the coil component according to the third embodiment of the present invention. A state in which the wire end is provided on the metal terminal is shown.
Figure 12:
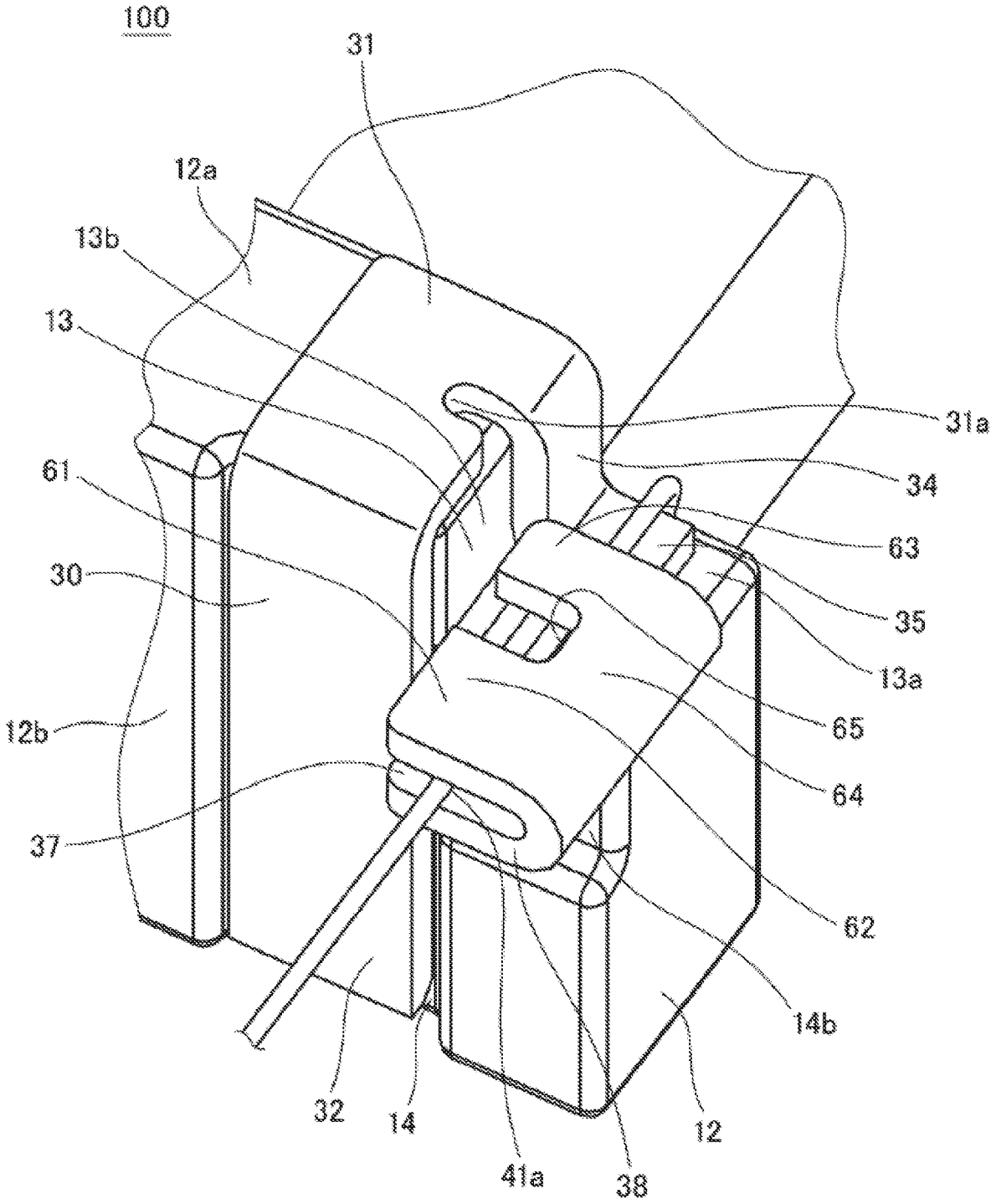
FIG. 12 is a partial enlarged perspective view that shows the coil component viewed from the bottom surface according to the third embodiment of the present invention. A state in which the wire end is crimped and fixed is shown.
Figure 13:
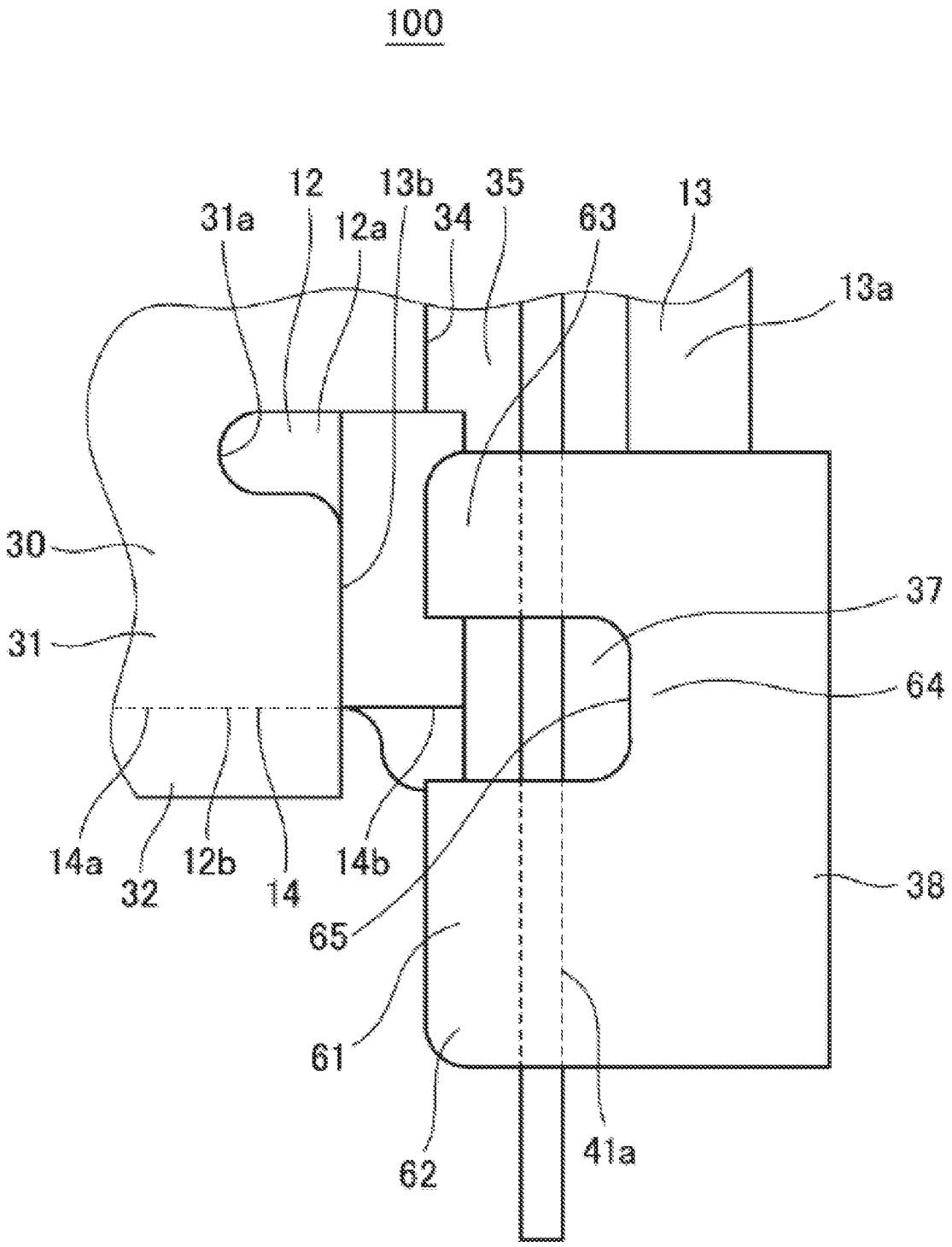
FIG. 13 is a partial enlarged bottom view that shows the coil component according to the third embodiment of the present invention. A state in which the wire end is crimped and fixed is shown.
Figure 14:
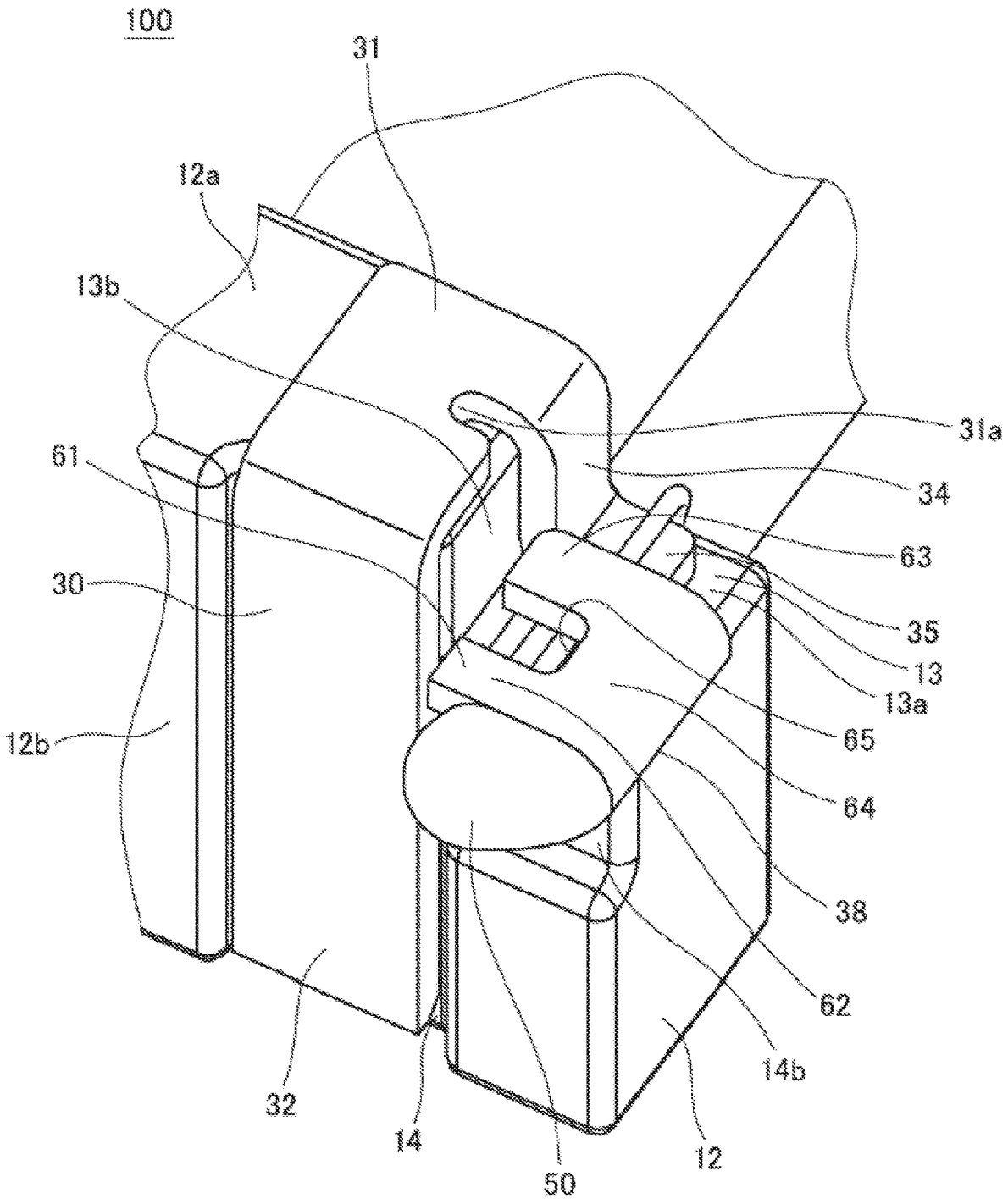
FIG. 14 is a partial enlarged perspective view that shows the coil component viewed from the bottom surface according to the third embodiment of the present invention. A state is shown after welding is conducted.
Figure 15:
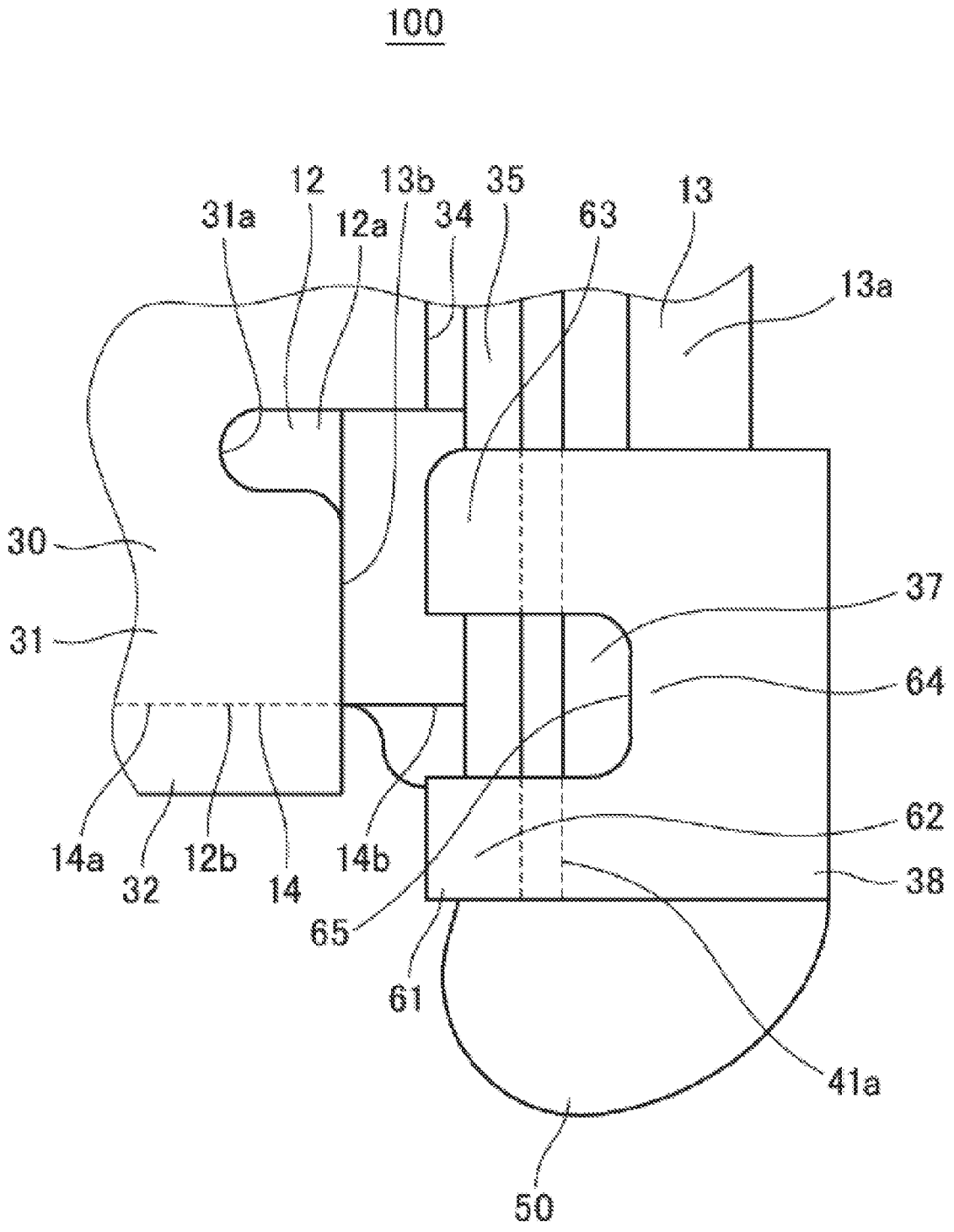
FIG. 15 is a partial enlarged bottom view that shows the coil component according to the third embodiment of the present invention. A state is shown after welding is conducted.

FIG. 10 is a perspective view that shows a coil component 100 viewed from a bottom surface according to a third embodiment of the present invention. FIG. 11 is a side view that shows the coil component 100 according to the third embodiment of the present invention. FIG. 11 shows a state in which a wire end is arranged at a corresponding metal terminal 30. FIG. 12 is a partial enlarged perspective view that shows the coil component 100 viewed from the bottom surface according to the third embodiment of the present invention. FIG. 12 shows a state in which the wire end is crimped and fixed. FIG. 13 is a partial enlarged bottom view that shows the coil component 100 according to the third embodiment of the present invention. FIG. 13 shows a state in which the wire end is crimped and fixed. FIG. 14 is a partial enlarged perspective view that shows the coil component 100 viewed from the bottom surface according to the third embodiment of the present invention. FIG. 15 is a partial enlarged bottom view that shows the coil component 100 according to the third embodiment of the present invention. FIGS. 14 and 15 respectively show a state in which the welding is already performed.

The coil component 100 according to the present embodiment is different from the coil component 100 according to the second embodiment explained above with respect to the configuration of the metal terminal 30. In other respects (configurations), the coil component 100 according to the present embodiment is configured in the same way as the coil component 100 according to the second embodiment explained above.

In the present embodiment, the metal terminal 30 does not have the entwining part 36 (shown in FIG. 6, etc.) and the crimp piece 39.

Instead, the metal terminal 30 has a folding piece 61 explained below.

The folding piece 61 is continuously connected to the tip part in the extending direction of the outer extension part 38 extending from the axial direction extension part 37. The folding piece 61 of the left metal terminal 30 is continuously connected to the left end of the outer extension part 38, and the folding piece 61 of the right metal terminal 30 is continuously connected to the right end of the outer extension part 38.

However, the present invention is not limited to the above features. The folding piece 61 can be continuously connected to the notch opposite surface arrangement section 35 and the outer extension part 38. Further, the folding piece 61 can also be continuously connected to the notch opposite surface arrangement section 35.

The folding piece 61 has a first crimp piece 63, a second crimp piece 62, and a connection portion 64. Specifically, the second crimp piece 62 is provided at the external side in the axial direction than the first crimp piece 63. The connection portion 64 connects between the second crimp piece 62 and the first crimp piece 63. A cut part 65 is formed at a position corresponding to the connection portion 64 in the folding piece 61.

The wire end is crimped and fixed at the first crimp piece 63.

The wire end is crimped and fixed, and further welded at the second crimp piece 62. After the wire end is crimped and fixed by the second crimp piece 62, the wire end is welded to, for instance, the second crimp piece 62, the outer extension part 38, and the first crimp piece 63.

As shown in FIGS. 10 and 11, in a state in which the crimp fixation of the wire end by utilizing the first crimp piece 63 and the second crimp piece 62 by folding back the folding piece 61 is not performed, the folding piece 61 is in a state in which the folding piece 61 downwardly rises from the tip part in the extending direction of the outer extension part 38. In this state, the folding piece 61 is, for instance, bent substantially perpendicularly to the axial direction extension part 37 and the outer extension part 38. Further, in this state, an angle formed between the folding piece 61, and the axial direction extension part 37 and the outer extension part 38 can be greater than 90 degrees. It is more preferable that the angle is 100 degrees or greater.

As shown in FIGS. 12 and 13, in a state in which the crimp fixation of the wire end by utilizing the first crimp piece 63 and the second crimp piece 62 is already performed, the folding piece 61 is in a folded-back shape that is obtained by being folded back from the axial direction extension part 37 (via the outer extension part 38). That is, the folding piece 61 and the axial direction extension part 37 are opposed to each other so as to sandwich the wire therebetween. As a result, the wire end is crimped and fixed by the first crimp piece 63 and the axial direction extension part 37, and at the same time, the wire end is crimped and fixed by the second crimp piece 62 and the axial direction extension part 37.

As explained above, the folding piece 61 is in the folded-back shape that is obtained by being folded back from the edge of the axial direction extension part 37 in the direction orthogonal to the axial direction toward an axial center side (inside) of the axial direction extension part 37 so that the wire end is crimped and fixed.

The left folding piece 61 is folded back from the left edge to the right edge of the axial direction extension part 37 (via the outer extension part 38). The right folding piece 61 is folded back from the right edge to the left edge of the axial direction extension part 37 (through the outer extension part 38).

However, the present invention is not limited to the above features. At least the first crimp piece 63 of the folding piece 61 can be in the folded-back shape that is obtained by being folded back from the notch opposite surface arrangement section 35 and the axial direction extension part 37, or can also be in the folded-back shape that is obtained by being folded back from the notch opposite surface arrangement section 35.

As shown in FIGS. 14 and 15, in a state in which the welding is already performed, for instance, because parts of each of the second crimp pieces 62, the outer extension part 38, and the axial direction extension part 37 are melted and integrated with the wire end, a weld ball 50 is formed.

However, the present invention is not limited to the above features. Specifically, only a part of the second crimp piece 62 can be melted and integrated with the wire end by the welding, or only a part of the axial direction extension part 37 can be melted and integrated with the wire end by the welding.

As explained above, the notch shape part 13 has the raised surface 13*b* and the notch opposite surface 13*a*. Specifically, the raised surface 13*b* is parallel to the axial direction and is orthogonal to the opposite surface 12*a*. The notch opposite surfaces 13*a* is provided opposed to the mounting target surface. The metal terminal 30 has the bottom plate 31, the raised part 34, the notch opposite surface arrangement section 35, and the axial direction extension part 37. Specifically, the bottom plate 31 is provided along the opposite surface 12*a* of the flange part 12. The raised part 34 rises from the bottom plate 31 along the raised surface 13*b* of the notch shape part 13. The notch opposite surface arrangement section 35 extends from the raised part 34 along the notch opposite surfaces 13*a* of the notch shape part 13. The axial direction extension part 37 extends from the notch opposite surface arrangement section 35 in the axial direction. The wire end is fixed by the welding at the position that is located at the external side in the axial direction and at the tip side of the axial direction extension part 37 of the metal terminal 30.

Note that the phrase "at the position that is located at the external side in the axial direction and at the tip side of the axial direction extension part 37 of the metal terminal 30" means that a part of the axial direction extension part 37 can be included, or a part of the axial direction extension part 37 cannot be included. That is, for instance, it is also possible that only a part of the second crimp piece 62 can be included. In the present embodiment, for instance, as explained above, the wire end is welded to the parts of each of the second crimp piece 62, the outer extension part 38, and the axial direction extension part 37.

Further, the metal terminal 30 has the first crimp piece 63 and the second crimp piece 62. The first crimp piece 63 is in the folded-back shape that is obtained by being folded back from at least one of the axial direction extension part 37 and the notch opposite surface arrangement section 35 so that the wire end is crimped and fixed. The second crimp piece 62 is in the folded-back shape that is obtained by being folded back from the axial direction extension part 37 so that the wire end is crimped and fixed. The second crimp piece 62 is provided at the external side in the axial direction than the first crimp piece 63. The wire end is welded to the end of the external side in the axial direction of at least one of the second crimp piece 62 and the axial direction extension part 37.

Further, because the wire end is respectively crimped and fixed by the first crimp piece 63 and the second crimp piece 62, the tension of the wire end between the first crimp piece 63 and the second crimp piece 62 can be reduced. In other words, the tension of the wire end can be dispersed to the first crimp piece 63 and the second crimp piece 62. As a result, the damage and the disconnection (breaking) of the wire end such as at the time of the welding can be suppressed.

In the present embodiment, the end of the external side in the axial direction of the second crimp piece 62 and the end of the external side in the axial direction of the axial direction extension part 37 are flush with each other. Therefore, it is easily performed that the wire end is welded by melting not only the second crimp piece 62, but also the axial direction extension part 37.

However, the present invention is not limited to the above features. It is also possible that the axial direction extension part 37 projects toward the external side in the axial direction than the second crimp piece 62.

As shown in FIG. 11, the second crimp piece 62 is provided at the external side in the axial direction than the portion (the horizontal direction extension part 14*b*) that is adjacent to the notch opposite surfaces 13*a* on the surface (the outer surface 12*b*) of the flange part 12 at the external side in the axial direction.

Further, the first crimp piece 63 and the second crimp piece 62 are respectively configured by parts of the folding piece 61. The folding piece 61 is in the folded-back shape that is obtained by being folded back from at least one of the axial direction extension part 37 and the notch opposite surface arrangement section 35. Therefore, because the folding piece 61 is bolded back, the crimp fixations by both the first crimp piece 63 and the second crimp piece 62 can be performed at one time.

Further, though an illustration is omitted from the drawings, even in the present embodiment, the coil component 100 has the plate core 20 (refer to FIG. 5).

Next, an example of the procedure to manufacture the coil component 100 according to the present embodiment will be explained below.

First, as shown in FIGS. 10 and 11, the first wire 41 and the second wire 42 are wound around the shaft part 11. The one end 41*a* and the other end 41*b* of the first wire 41 and the one end 42*a* and the other end 42*b* of the second wire 42 are arranged along the corresponding axial direction extension part 37 of the corresponding metal terminal 30.

Further, in regards to each of the wire ends (the one end 41*a*, the other end 41*b*, the one end 42*a* and the other end 42*b*), the part of the tip side of the wire end beyond the portion that is provided along the axial direction extension part 37 is held by an external jig (not shown).

Next, as shown in FIGS. 12 and 13, each of the folding pieces 61 is bent to the axial direction extension part 37 (via the outer extension part 38) so that each of the wire ends is crimped and fixed by the first crimp piece 63 and the second crimp piece 62.

Next, for instance, by irradiating a laser beam to the end of the external side of the second crimp piece 62 in the axial direction of each of the metal terminals 30, parts of each of the second crimp piece 62, the axial direction extension part 37, and the outer extension part 38, and each of the wire ends (the one end 41*a*, the other end 41*b*, the one end 42*a*, and the other end 42*b*) are welded. As a result, the weld ball (shown in FIGS. 14 and 15) is formed. The irradiation direction of the laser beam is, for instance, the upward direction from below. As explained above, each of the wire ends is welded to and is electrically connected to the corresponding metal terminal 30.

Thereafter, in the same way as the first embodiment, the plate core 20 is fixed to the drum core 10. As a result, the coil component 100 that has the drum core 10 and the plate core 20 can be obtained.

Fourth Embodiment

Next, a fourth embodiment of the present invention will be explained below with reference to FIGS. 16-18.

Figure 16:
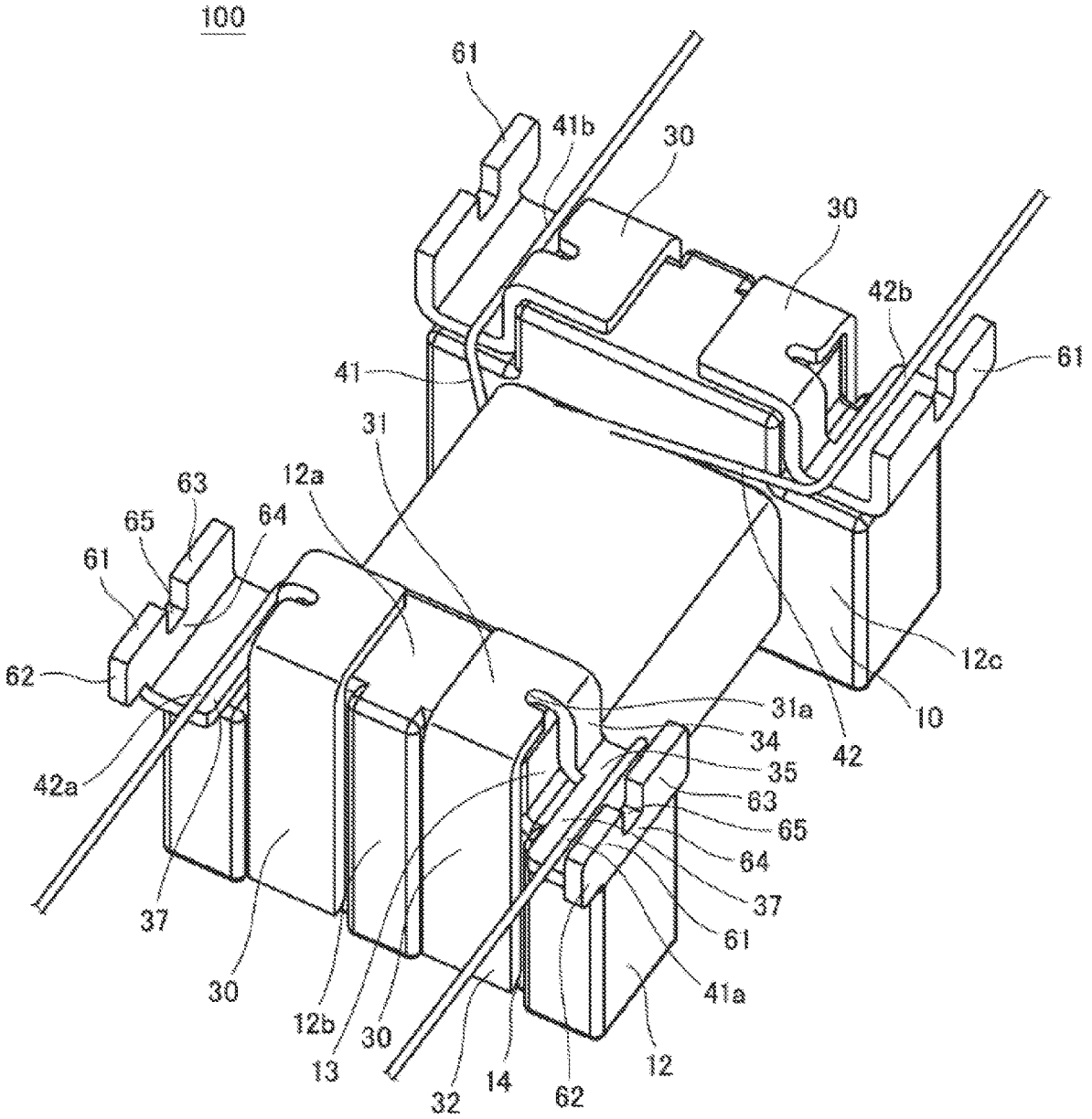
FIG. 16 is a perspective view that shows a coil component viewed from a bottom surface according to a fourth embodiment of the present invention. A state in which a wire end is provided on a metal terminal is shown.

FIG. 16 is a perspective view that shows the coil component 100 viewed from a bottom surface according to a fourth embodiment of the present invention. FIG. 16 shows a state in which a wire end is arranged at the metal terminal 30. FIG. 17 is a partial enlarged perspective view that shows the coil component 100 viewed from the bottom surface according to the fourth embodiment of the present invention. FIG. 17 shows a state in which the wire end is crimped and fixed. FIG. 18 is a partial enlarged perspective view that shows the coil component 100 viewed from the bottom surface according to the fourth embodiment of the present invention. FIG. 18 shows a state in which the welding is already performed.

The coil component 100 according to the present embodiment is different from the coil component 100 according to the third embodiment explained above with respect to the configuration of the metal terminal 30. In other respects (configurations), the coil component 100 according to the present embodiment is configured in the same way as the coil component 100 according to the third embodiment explained above.

In the third embodiment explained above, the folding piece 61 is continuously connected to the outer extension part 38 that laterally extends from the axial direction extension part 37. On the other hand, in the present embodiment, as shown in, for example, FIG. 16, the folding piece 61 is continuously connected to the axial direction extension part 37 and the notch opposite surface arrangement section 35. That is, the folding piece 61 is directly continuously connected to the axial direction extension part 37 without connecting to the outer extension part 38, and at the same time, the folding piece 61 is also continuously connected to the notch opposite surface arrangement section 35. More specifically, the folding piece 61 is continuously connected to the edges of the axial direction extension part 37 and the notch opposite surface arrangement section 35 in a direction orthogonal to the axial direction.

Further, in the third embodiment explained above, the end of the external side in the axial direction of the second crimp piece 62 and the end of the external side in the axial direction of the axial direction extension part 37 are flush with each other. On the other hand, in the present embodiment, the second crimp piece 62 projects toward the external side in the axial direction than the axial direction extension part 37.

Further, in the third embodiment explained above, the second crimp piece 62 is completely provided at the external side in the axial direction than the horizontal direction extension part 14*b*. On the other hand, in the present embodiment, the second crimp piece 62 is not completely provided at the external side in the axial direction than the horizontal direction extension part 14*b*. However, even in the present embodiment, the axial direction extension part 37 and the second crimp piece 62 project toward the external side in the axial direction than the recessed part 14.

Even in the present embodiment, the wire end is fixed by the welding at the position that is located at the external side in the axial direction and at the tip side of the axial direction extension part 37 of the metal terminal 30.

Even in the present embodiment, the wire end is welded to the end of the external side in the axial direction of at least one of the second crimp piece 62 and the axial direction extension part 37.

Figure 17:
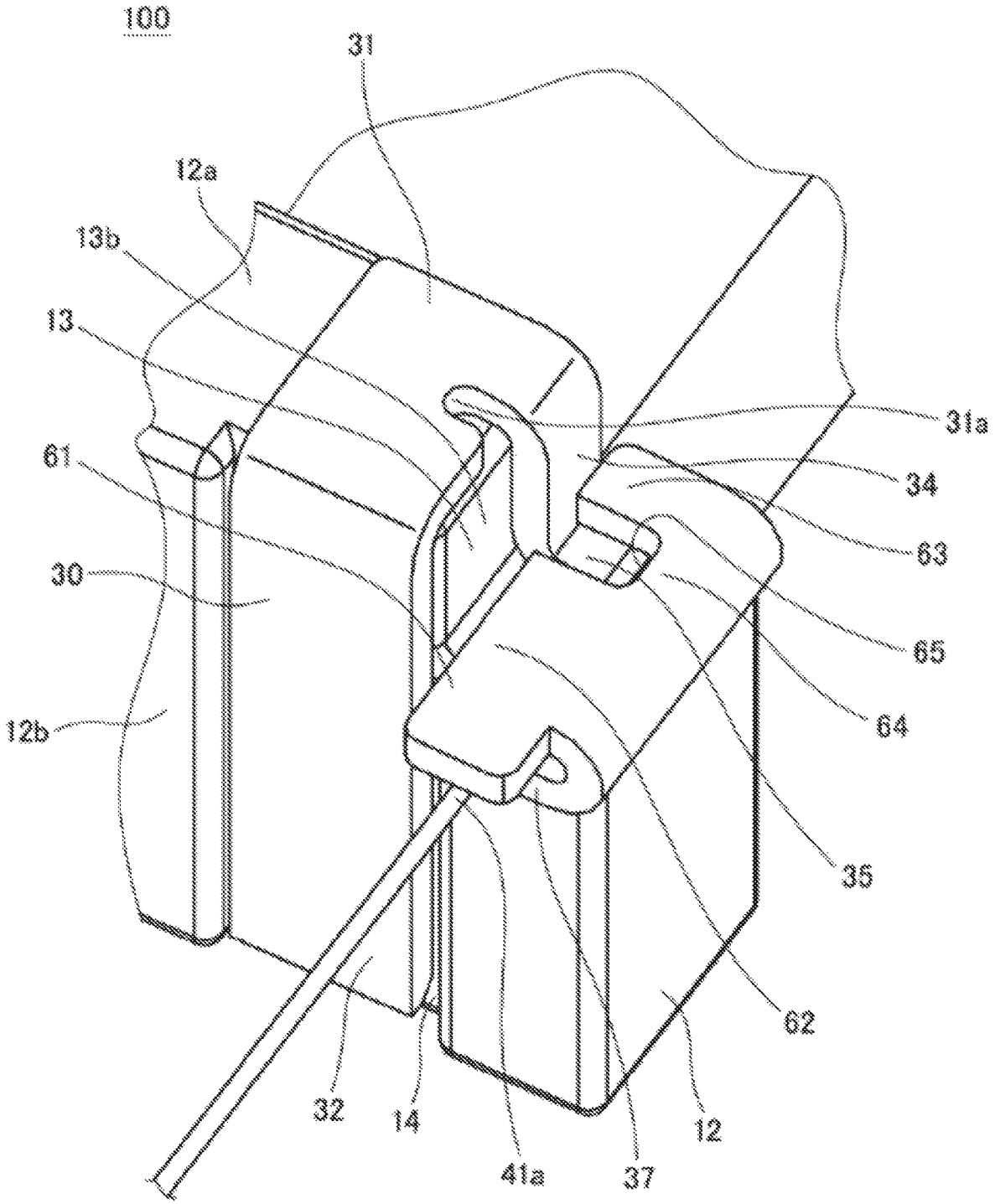
FIG. 17 is a partial enlarged perspective view that shows the coil component viewed from the bottom surface according to the fourth embodiment of the present invention. A state in which the wire end is crimped and fixed is shown.
Figure 18:
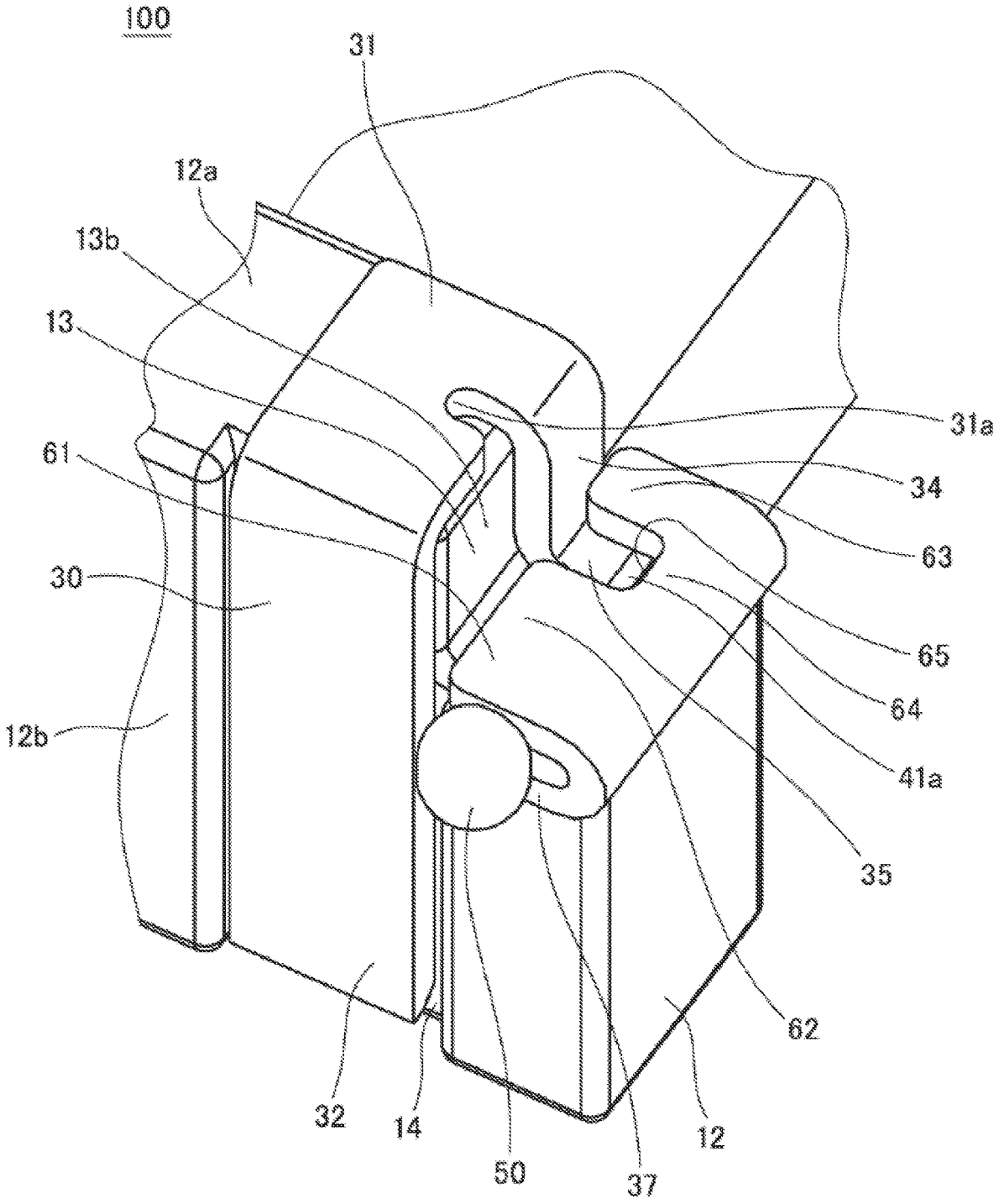
FIG. 18 is a partial enlarged perspective view that shows the coil component viewed from the bottom surface according to the fourth embodiment of the present invention. A state is shown after welding is conducted.

More specifically, in the present embodiment, for instance, the wire end is welded to the portion of the second crimp piece 62 that projects toward the external side in the axial direction than the axial direction extension part 37 (refer to FIGS. 17 and 18).

Even in the present embodiment, the procedure to manufacture the coil component 100 is in the same way as the third embodiment explained above.

Fifth Embodiment

Next, a Fifth embodiment of the present invention will be explained below with reference to FIGS. 19-23.

Figure 19:
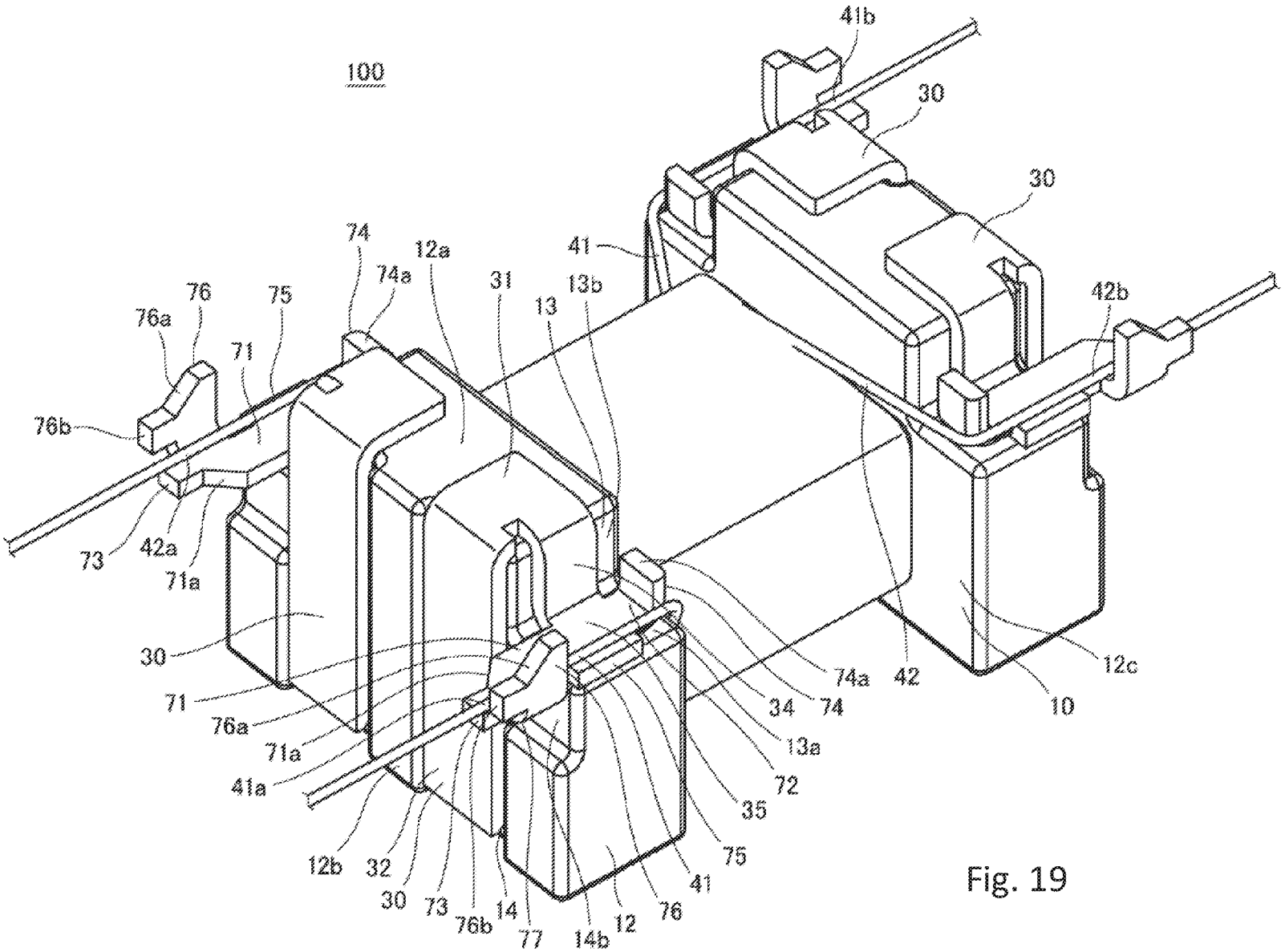
FIG. 19 is a perspective view that shows a coil component viewed from a bottom surface according to a fifth embodiment of the present invention. A state in which a wire end is provided on a metal terminal is shown.
Figure 20:
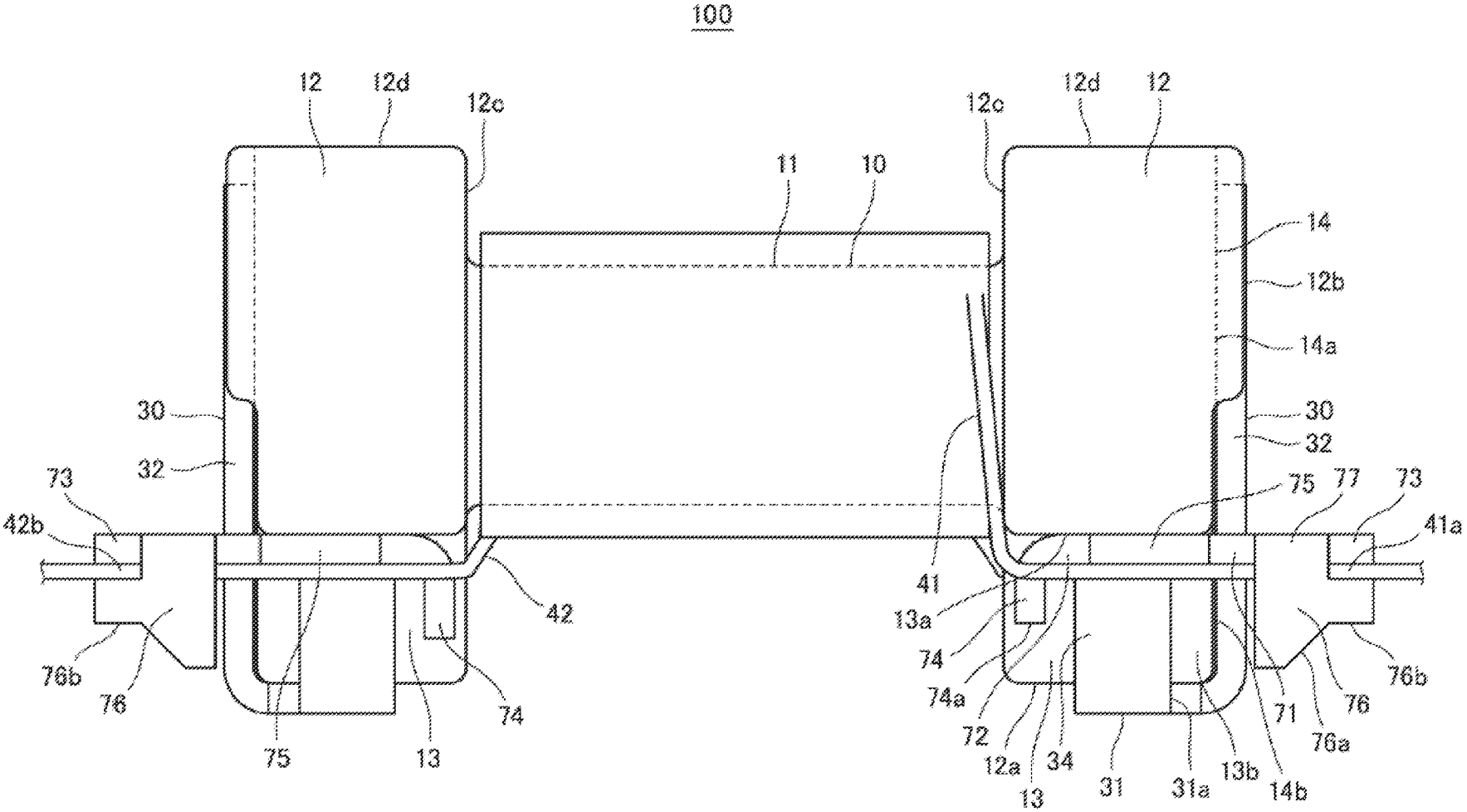
FIG. 20 is a side view that shows the coil component according to the fifth embodiment of the present invention. A state in which the wire end is provided on the metal terminal is shown.
Figure 21:
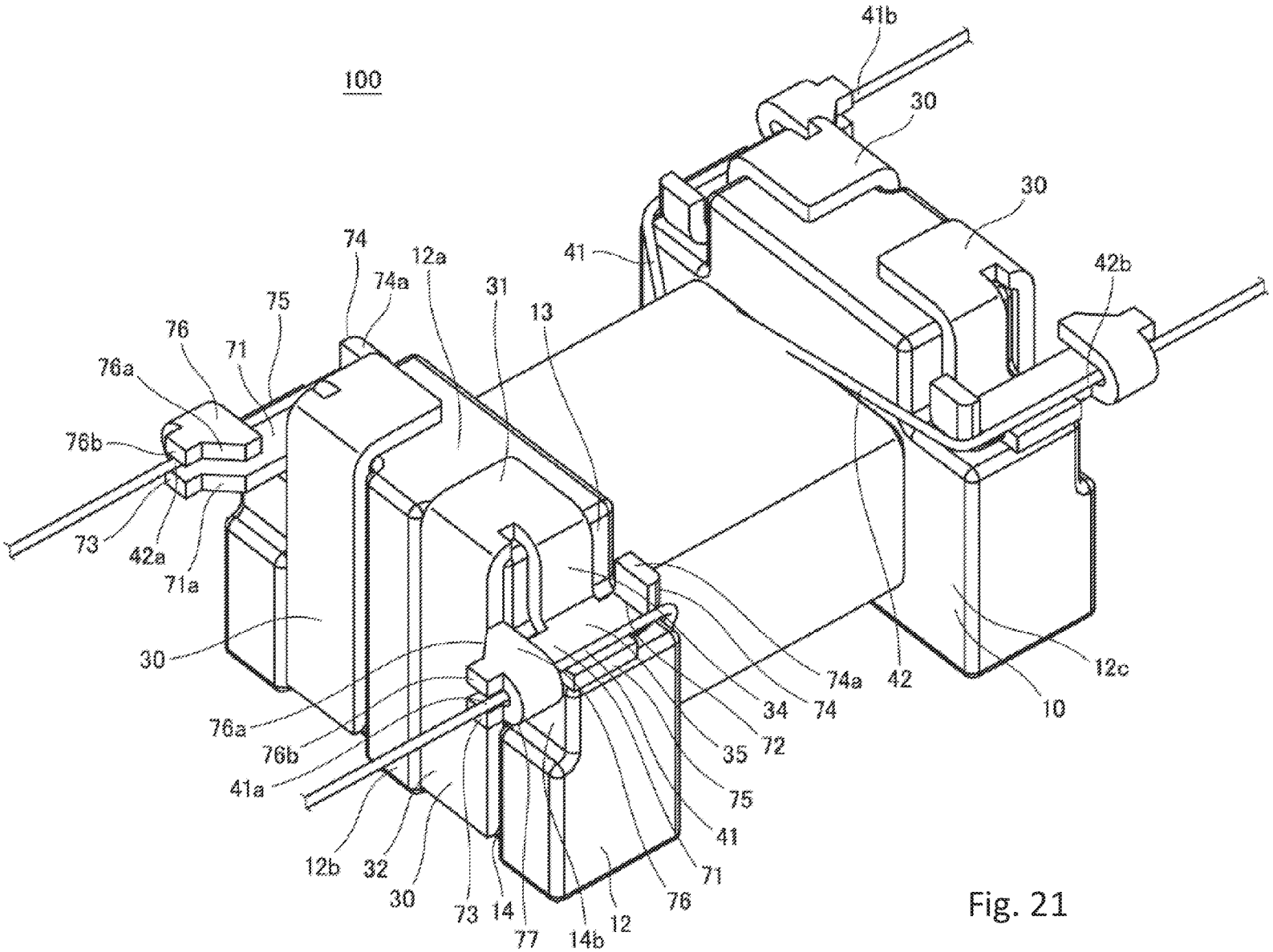
FIG. 21 is a partial enlarged perspective view that shows the coil component viewed from the bottom surface according to the fifth embodiment of the present invention. A state in which the wire end is crimped and fixed is shown.
Figure 22:
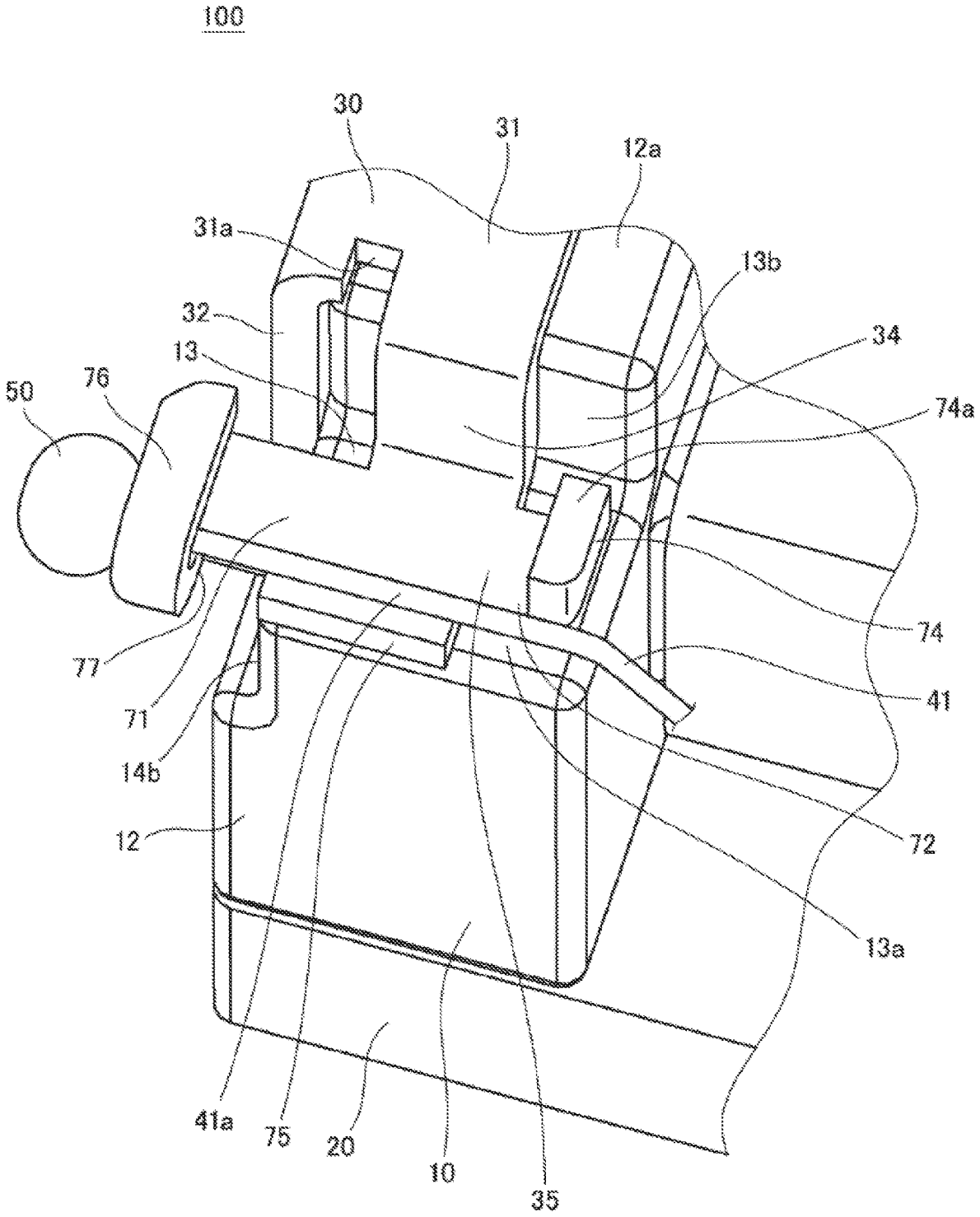
FIG. 22 is a partial enlarged perspective view that shows the coil component viewed from the bottom surface according to the fifth embodiment of the present invention. A state is shown after welding is conducted.
Figure 23:
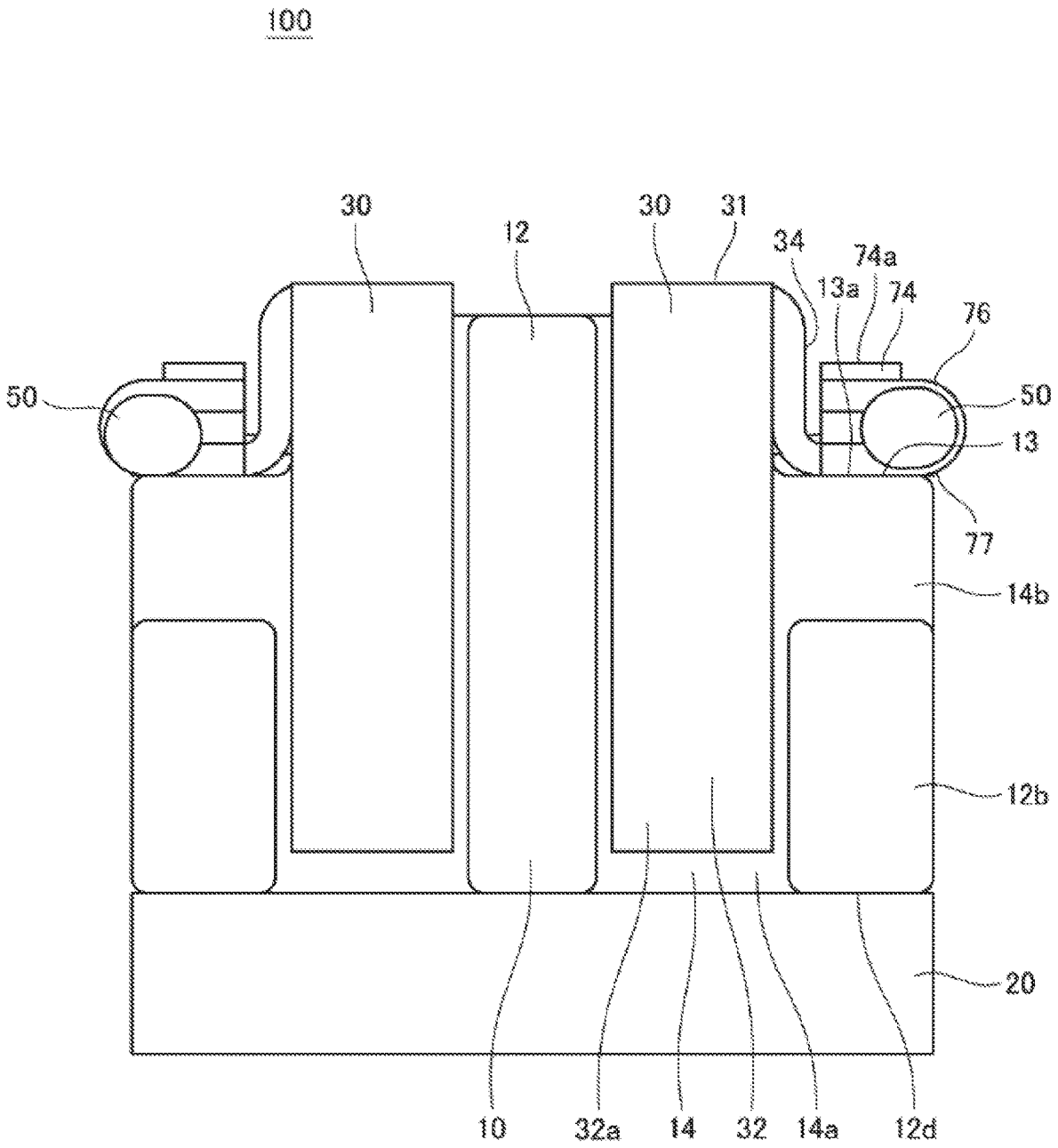
FIG. 23 is a front view that shows the coil component according to the fifth embodiment of the present invention. A state is shown after welding is conducted.

FIG. 19 is a perspective view that shows a coil component 100 viewed from a bottom surface according to a fifth embodiment of the present invention. FIG. 20 is a side view that shows the coil component 100 according to the fifth embodiment of the present invention. FIGS. 19 and 20 respectively show a state in which a wire end is arranged at a metal terminal 30. FIG. 21 is a partial enlarged perspective view that shows the coil component 100 viewed from the bottom surface according to the fifth embodiment of the present invention. FIG. 21 shows a state in which the wire end is crimped and fixed. FIG. 22 is a partial enlarged perspective view that shows the coil component 100 viewed from the bottom surface according to the fifth embodiment of the present invention. FIG. 23 is a front view that shows the coil component 100 according to the fifth embodiment of the present invention. FIGS. 22 and 23 show a state in which the welding is already performed.

The coil component 100 according to the present embodiment is different from the coil component 100 according to the first embodiment explained above with respect to the configuration of the metal terminal 30. In other respects (configurations), the coil component 100 according to the present embodiment is configured in the same way as the coil component 100 according to the first embodiment explained above.

In the present embodiment, the metal terminal 30 does not have the horizontal direction extension part 32*b* and the weld part 33 that are respectively shown in FIG. 2. That is, the flat base part 32 is configured by the vertical direction extension part 32*a* that is explained in the first embodiment. Further, in the present embodiment, the metal terminal 30 does not have the entwining part 36 shown in FIG. 2.

Instead, in the present embodiment, the metal terminal 30 has a first axial direction extension part 71, a second axial direction extension part 72, a positioning raised part (positioning raised tab) 74, a lateral projection 75, a crimp piece 76, and a connection part 77 that are respectively explained below.

In the present embodiment, the bottom plate 31 does not reach the end of the opposite surface 12*a* at the inner side in the axial direction. Similarly, the raised part 34 does not reach the end of the raised surface 13*b* at the inner side in the axial direction. Further, similarly, the notch opposite surface arrangement section 35 does not reach the end of the notch opposite surfaces 13*a* at the inner side in the axial direction.

In other words, the ends of the bottom plates 31, the raised part 34, and the notch opposite surface arrangement section 35 of the metal terminal 30 at the inner side in the axial direction are located at positions toward the external side in the axial direction than the inner surface 12*c* of the flange part 12.

As shown in such as FIG. 19, the first axial direction extension part 71 extends from the notch opposite surface arrangement section 35 to the external side in the axial direction. More specifically, for instance, the first axial direction extension part 71 has a part that is provided along the notch opposite surfaces 13*a* and a part that projects from such part toward the external side in the axial direction (i.e., the part that projects from the flange part 12 toward the external side in the axial direction). The first axial direction extension part 71 is provided on the same plane as the notch opposite surface arrangement section 35.

At the tip part in the extending direction of the first axial direction extension part 71, a notch shape portion 71*a* is formed at an edge of the inner side in a direction crossing the axial direction. As a result, at the tip part in the extending direction of the first axial direction extension part 71, a narrow-width weld piece 73 is formed.

More specifically, the notch shape portion 71*a* includes a tapered part. At the tip part in the extending direction of the first axial direction extension part 71, a width of the portion that is adjacent to the side of the lateral projection 75 (the inner side in the axial direction) with respect to the narrow-width weld piece 73 becomes gradually narrower toward a tip side (the external side in the axial direction). The narrow-width weld piece 73 is continuously connected to the tip side of the portion that becomes gradually narrower toward the tip side in the first axial direction extension part 71.

At the tip part in the extending direction of the first axial direction extension part 71, the crimp piece 76 is continuously connected to the edge of the external side with respect to the direction crossing the axial direction via the connection part 77. More specifically, at the tip part in the extending direction of the first axial direction extension part 71, the crimp piece 76 is continuously connected to the portion that is located at the inner side in the axial direction than the narrow-width weld piece 73 via the connection part 77. In other words, the narrow-width weld piece 73 projects toward the external side in the axial direction than the connection part 77.

The wire end is crimped and fixed, and welded to the crimp piece 76. After the wire end is crimped and fixed by the crimp piece 76, the wire end is welded to the crimp piece 76.

As shown FIG. 20, the crimp piece 76 is provided at the external side in the axial direction than the portion (the horizontal direction extension part 14*b*) that is adjacent to the notch opposite surfaces 13*a* on the surface (the outer surface 12*b*) of the flange part 12 at the external side in the axial direction.

Therefore, it is easily performed that the wire end is crimped and fixed by bending the crimp piece 76 without the interference with the flange part 12.

More specifically, the crimp piece 76 is, for instance, provided at the external side in the axial direction than the flat base part 32.

As shown in FIGS. 19 and 20, in a state in which the crimp fixation of the wire end by utilizing the crimp piece 76 is not performed, the crimp piece 76 is in a state in which the crimp piece 76 downwardly rises from the first axial direction extension part 71 via the connection part 77. In this state, the crimp piece 76 is, for instance, bent substantially perpendicularly to the first axial direction extension part 71 with respect to the connection part 77. Further, in this state, an angle formed between the crimp piece 76 and the first axial direction extension part 71 can be greater than 90 degrees. It is more preferable that the angle is 100 degrees or greater.

When the crimp piece 76 is crimped as shown in FIG. 21, the crimp piece 76 overlaps with the tip part of the first axial direction extension part 71 in the vertical direction with respect to the shape.

At an opposite edge with respect to a side of the first axial direction extension part 71 (the side of the connection part 77) of the crimp piece 76, a notch shape portion 76*a* is formed. As a result, at the end of the external side in the axial direction of the crimp piece 76, a narrow-width weld piece 76*b* is formed.

More specifically, the notch shape portion 76*a* includes a tapered part. A width of a part at the external side in the axial direction of the crimp piece 76 becomes gradually narrower toward the external side in the axial direction. The (narrow-width) weld piece 76*b* is continuously connected to the portion that becomes gradually narrower toward the external side in the axial direction of the crimp piece 76.

As shown in FIG. 21, in a state in which the crimp fixation of the wire end by utilizing the crimp piece 76 is already performed, the crimp piece 76 is in a folded-back shape that is obtained by being folded back from the first axial direction extension part 71 (via the connection part 77). That is, the crimp piece 76 and the first axial direction extension part 71 are opposed to each other while the crimp piece 76 and the first axial direction extension part 71 sandwich the wire therebetween. As a result, the wire end is crimped and fixed by being held by the crimp piece 76 and the first axial direction extension part 71.

As explained above, the crimp piece 76 is in the folded-back shape that is obtained by being folded back from the outer edge of the first axial direction extension part 71 to the inner edge in the direction orthogonal to the axial direction so that the wire end is crimped and fixed.

The left crimp piece 76 is folded back from the left edge at the tip part (the end at the external side in the axial direction) of the first axial direction extension part 71. The right crimp piece 76 is folded back from the right edge at the tip part (the end at the external side in the axial direction) of the first axial direction extension part 71.

As shown in FIGS. 22 and 23, in a state in which the welding is performed, a part of the crimp piece 76 (for instance, the narrow-width weld piece 76*b*) and a part of the first axial direction extension part (for instance, the narrow-width weld piece 73) are melted and integrated with the wire end. As a result, the weld ball 50 is formed.

Further, the inner side parts of the crimp piece 76 and the first axial direction extension part 71 in the axial direction that are located at the inner side than the narrow-width weld piece 76*b* and the narrow-width weld piece 73 can also form the weld ball 50 by being melted.

Similarly, the part of the connection part 77 can also form the weld ball 50 by being melted.

Further, the present invention is not limited to the above features. Only the part of the crimp piece 76 can be integrated with the wire end by the welding, or only the part of the first axial direction extension part 71 can also be integrated with the wire end by the welding.

Further, as shown in FIG. 23, for instance, a half or more of the weld ball 50 is placed inside of a space defined by the notch shape part 13.

The connection part 77 is located at the base end of the crimp piece 76 and mutually connects between the crimp piece 76 and the first axial direction extension part 71. The connection part 77 is, for instance, formed in a longitudinal configuration in the axial direction (extending in the axial direction).

The second axial direction extension part 72 extends from the notch opposite surface arrangement section 35 to the inner side in the axial direction, and the second axial direction extension part 72 is provided along the notch opposite surfaces 13*a*.

The positioning raised part 74 rises from the end part of the second axial direction extension part 72 at the inner side in the axial direction toward the mounting target surface. However, the present invention is not limited to the above features. The positioning raised part 74 may rise from the notch opposite surface arrangement section 35 toward the mounting target surface. The plate surfaces of the positioning raised part 74 face, for instance, toward the inner side and the external side in the axial direction, respectively.

More specifically, the positioning raised part 74 is provided at the edge at the inner side in the axial direction in the space defined by the notch shape part 13.

As shown in FIG. 20, a tip 74*a* of the positioning raised part 74 in the rising direction is located above the opposite surface 12*a*.

The positioning raised part 74 positions the wire end in the direction crossing the axial direction. That is, the left end of the left positioning raised part 74 regulates the movement of the wire end toward the right, and the right end of the right positioning raised part 74 regulates the movement of the wire end toward the left.

The lateral projection 75 laterally projects from the notch opposite surface arrangement section 35 and the first axial direction extension part 71. However, the present invention is not limited to the above features. The lateral projection 75 can laterally project only from the notch opposite surface arrangement section 35. Alternatively, the lateral projection 75 can also laterally project only from the first axial direction extension part 71.

The left lateral projection 75 projects from the left edges of the notch opposite surface arrangement section 35 and the first axial direction extension part 71 toward the left side. The right lateral projection 75 projects from the right edges of the notch opposite surface arrangement section 35 and the first axial direction extension part 71 toward the right side.

The lateral projection 75 is, for instance, formed in a longitudinal configuration in the axial direction (extending in the axial direction). Further, for instance, the connection part 77 is provided at the position on the extension line of the lateral projection 75.

Because the crimp piece 76 and the connection part 77 are spaced apart from the lateral projection 75, the crimp piece 76 does not interfere with the lateral projection 75 when the crimp piece 76 is crimped.

The lateral projection 75 regulates the movement of the wire end toward the notch opposite surfaces 13*a* between the positioning raised part 74 and the crimp piece 76.

As explained above, in the present embodiment, the notch shape part 13 has the raised surface 13*b* and the notch opposite surface 13*a*. Specifically, the raised surface 13*b* is parallel to the axial direction and is orthogonal to the opposite surface 12*a*. The notch opposite surface 13*a* is provided opposite to the mounting target surface. The metal terminal 30 has the bottom plate 31, the raised part 34, the notch opposite surface arrangement section 35, and the axial direction extension part (the first axial direction extension part 71). Specifically, the bottom plate 31 is provided along the opposite surface 12*a* of the flange part 12. The raised part 34 rises from the bottom plate 31 along the raised surface 13*b* of the notch shape part 13. The notch opposite surface arrangement section 35 extends from the raised part 34 along the notch opposite surface 13*a* of the notch shape part 13. The axial direction extension part (the first axial direction extension part 71) extends from the notch opposite surface arrangement section 35 in the axial direction. The wire end is fixed by the welding at the position that is located at the external side in the axial direction and at the tip side of the axial direction extension part of the metal terminal 30.

Further, the metal terminal 30 has the positioning raised part 74 and the crimp piece 76. The positioning raised part 74 rises from the notch opposite surface arrangement section 35 or the axial direction extension part (the first axial direction extension part 71) toward the mounting target surface side, and positions the wire end in the direction crossing the axial direction. The crimp piece 76 is in the folded-back shape that is obtained by being folded back from the axial direction extension part and crimps the wire end. The crimp piece 76 is provided at the external side in the axial direction than the positioning raised part 74. Further, the wire end is welded to the end at the external side in the axial direction of at least one of the crimp piece 76 and the axial direction extension part. Because the wire end can be crimped and fixed by the crimp piece 76 after the wire end is positioned by the positioning raised part 74, the wire end can be crimped and fixed after the wire end is placed at a desired route.

Further, the positioning raised part 74 rises from the end at the inner side in the axial direction of the part (the part including the first axial direction extension part 71, the notch opposite surface arrangement section 35, and the second axial direction extension part 72) that is provided along the notch opposite surfaces 13*a* of the metal terminal 30. Therefore, because the part right being pulled out from the shaft part 11 at each of the wire ends can be positioned by the positioning raised part 74, each of the wire ends can become easy to be positioned at a desired position.

Further, the metal terminal 30 has the lateral projection 75 that laterally projects from at least one of the axial direction extension part (the first axial direction extension part 71) and the notch opposite surface arrangement section 35. The lateral projection 75 regulates the movement of the wire end to the side of the notch opposite surfaces 13*a* in the area between the positioning raised part 74 and the crimp piece 76.

Further, as shown in FIGS. 22 and 23, even in the present embodiment, the coil component 100 has the plate core 20.

Next, an example of the procedure to manufacture the coil component 100 according to the present embodiment will be explained below.

First, as shown in FIGS. 19 and 20, the first wire 41 and the second wire 42 are wound around the shaft part 11. The one end 41*a* and the other end 41*b* of the first wire 41 and the one end 42*a* and the other end 42*b* of the second wire 42 are arranged at the corresponding metal terminal 30.

More specifically, each of the wire ends (the one end 41*a*, the other end 41*b*, the one end 42*a*, and the other end 42*b*) is bent along the positioning raised part 74 of the corresponding metal terminal 30, and furthermore, is arranged along the lateral projection 75. Further, such each of the wire ends is arranged along the connection part 77 or the first axial direction extension part 71 and is pulled outside.

Further, the part of the tip side of each of the wire ends beyond the portion that is provided along the first axial direction extension part 71 or the connection part 77 is held by an external jig (not shown).

Next, as shown in FIG. 21, each of the crimp pieces 76 is bent toward the first axial direction extension part 71 (via the connection part 77) so that each of the wire ends is crimped and fixed by being held by the crimp piece 76 and the first axial direction extension part 71.

Next, for instance, by irradiating a laser beam to the narrow-width weld piece 76*b* of the crimp piece 76 of each of the metal terminals 30, parts of each of the crimp pieces 76 including the narrow-width weld piece 76*b* and the narrow-width weld piece 73, and the first axial direction extension part 71, and a part of the connection part 77 are melted so as to be integrated with each of the wire ends (the one end 41*a*, the other end 41*b*, the one end 42*a*, and the other end 42*b*). As a result, the weld ball 50 is formed (shown in FIG. 22). The irradiation direction of the laser beam is, for instance, the upward direction from below. As explained above, each of the wire ends is welded to and is electrically connected to the corresponding metal terminal 30.

Thereafter, in the same way as the first embodiment, the plate core 20 is fixed to the drum core 10. As a result, the coil component 100 that has the drum core 10 and the plate core 20 can be obtained.

Sixth Embodiment

Next, a sixth embodiment of the present invention will be explained below with reference to FIG. 24.

Figure 24:
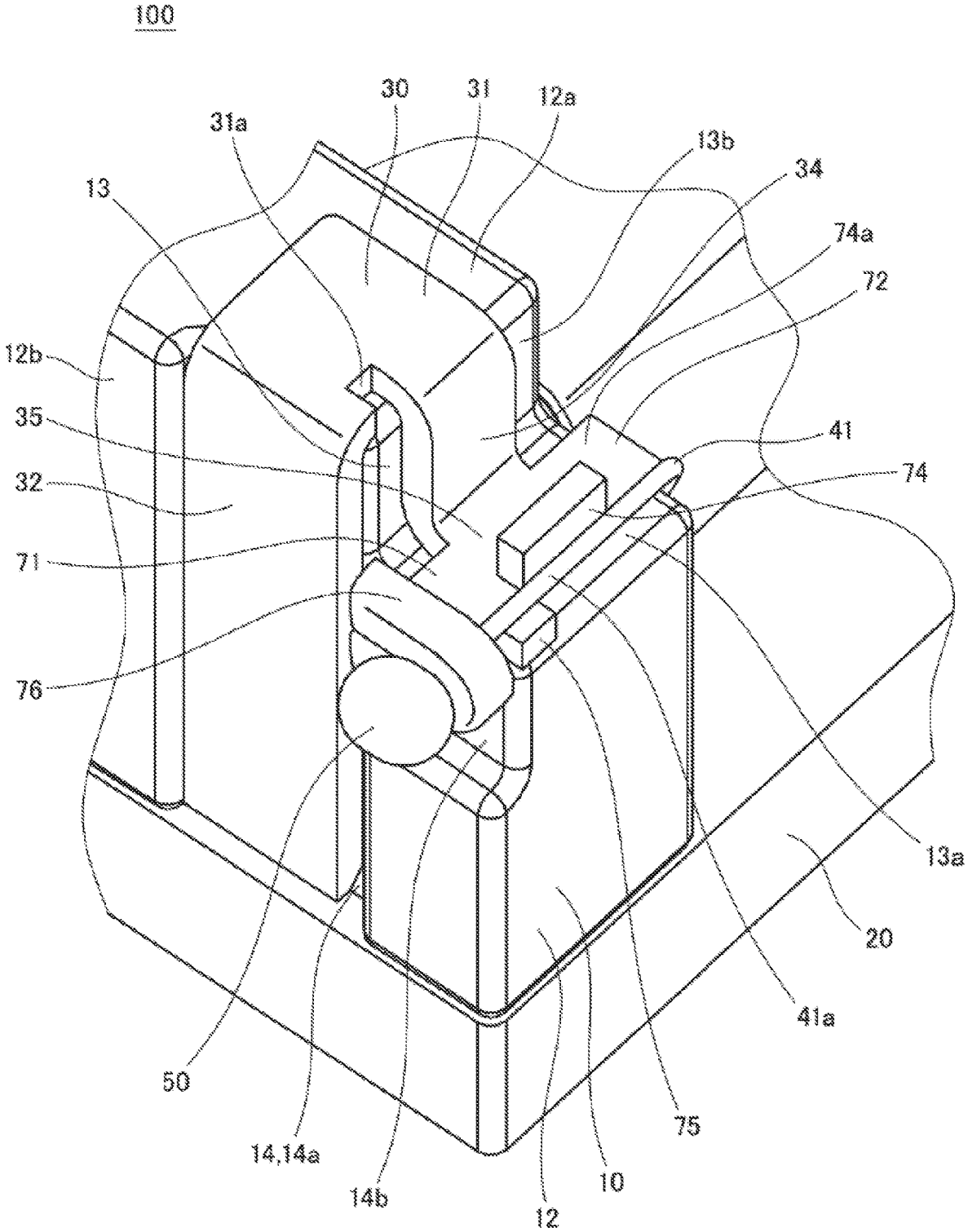
FIG. 24 is a partial enlarged perspective view that shows a coil component viewed from a bottom surface according to a sixth embodiment of the present invention. A state is shown after welding is conducted.

FIG. 24 is a partial enlarged perspective view that shows a coil component 100 viewed from a bottom surface according to a sixth embodiment of the present invention. FIG. 24 shows a state in which the welding is already performed.

The coil component 100 according to the present embodiment is different from the coil component 100 according to the fifth embodiment explained above with respect to the arrangement position of the positioning raised part 74 of the metal terminal 30. In other respects (configurations), the coil component 100 according to the present embodiment is configured in the same way as the coil component 100 according to the fifth embodiment explained above.

In the present embodiment, for instance, the positioning raised part 74 rises from the notch opposite surface arrangement section 35 at the position that is opposed to the raised part 34. The positioning raised part 74 is bent with respect to the notch opposite surface arrangement section 35. The plate surfaces of the positioning raised part 74 faces toward right and left (crosswise) directions. Further, the lateral projection 75 laterally projects from the first axial direction extension part 71.

Furthermore, the positioning raised part 74 extends parallel to the axial direction. Therefore, because the longer range of each of the wire ends can be positioned by the positioning raised part 74, each of the wire ends can be stably arranged at the desired position.

Seventh Embodiment

Next, a seventh embodiment of the present invention will be explained below with reference to FIGS. 25-27.

Figure 25:
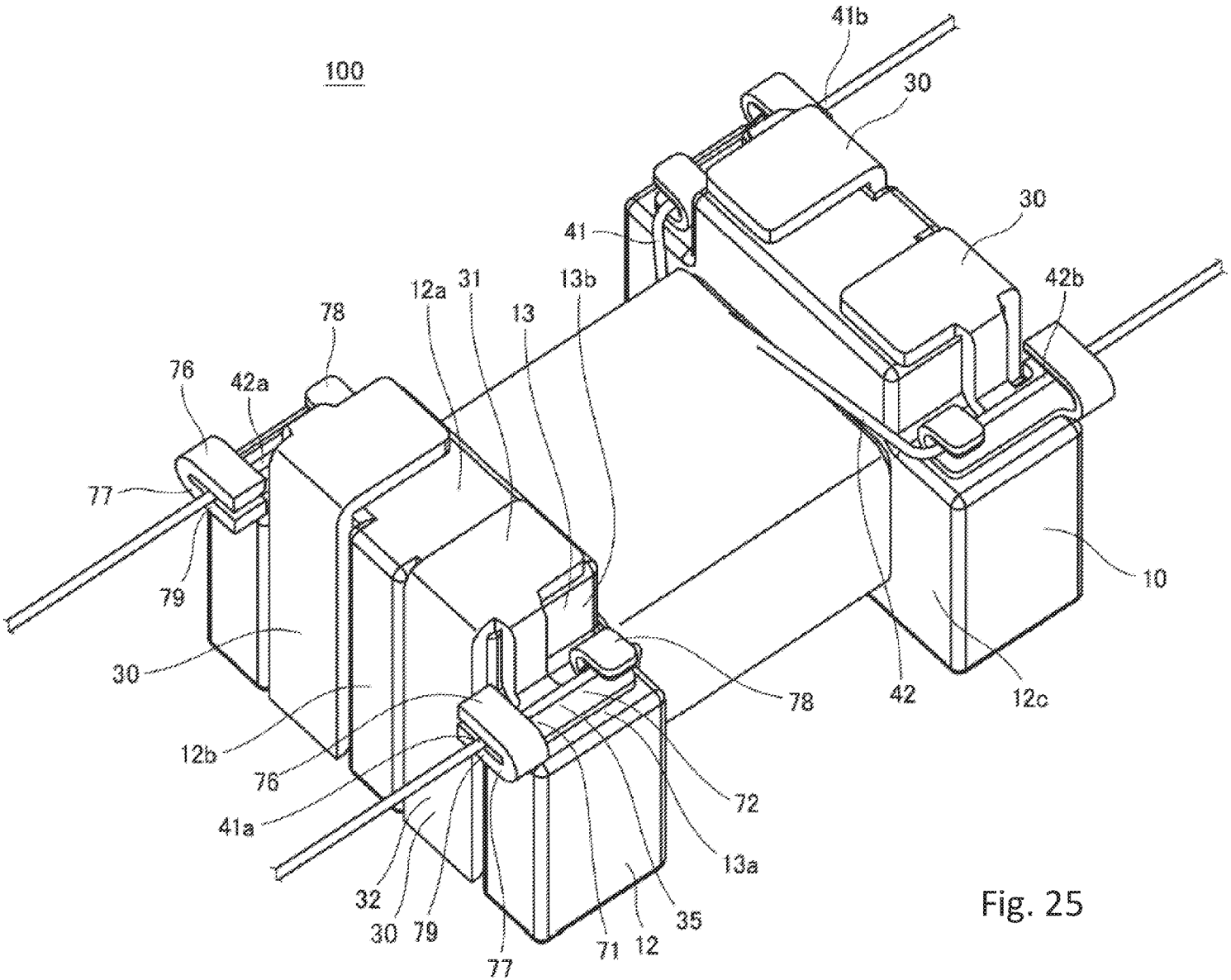
FIG. 25 is a perspective view that shows the coil component viewed from a bottom surface according to a seventh embodiment of the present invention. The state in which a wire end is crimped and fixed is shown.

FIG. 25 is a perspective view that shows a coil component 100 viewed from a bottom surface according to a seventh embodiment of the present invention. FIG. 26 is a side view that shows the coil component 100 according to the seventh embodiment of the present invention. FIGS. 25 and 26 respectively show a state in which a wire end is crimped and fixed. FIG. 27 is a partial enlarged perspective view that shows the coil component 100 viewed from the bottom surface according to the seventh embodiment of the present invention. FIG. 27 shows a state in which the welding is already performed.

The coil component 100 according to the present embodiment is different from the coil component 100 according to the fifth embodiment explained above with respect to the configuration of the metal terminal 30. In other respects (configurations), the coil component 100 according to the present embodiment is configured in the same way as the coil component 100 according to the fifth embodiment explained above.

In the present embodiment, the metal terminal 30 does not have the positioning raised part 74 and the lateral projection 75.

Further, the notch shape portion 71*a* and the notch shape portion 76*a* are not formed in the first axial direction extension part 71 and the crimp piece 76. As a result, the narrow-width weld piece 73 and the narrow-width weld piece 76*b* are not formed at the first axial direction extension part 71 and the crimp piece 76.

In the present embodiment, the crimp piece 76 corresponds to a second crimp piece (76).

In the present embodiment, the recessed part 14 does not have the horizontal direction extension part 14*b* so that the recessed part 14 is, for instance, configured by only the vertical direction extension part 14*a*.

Figure 26:
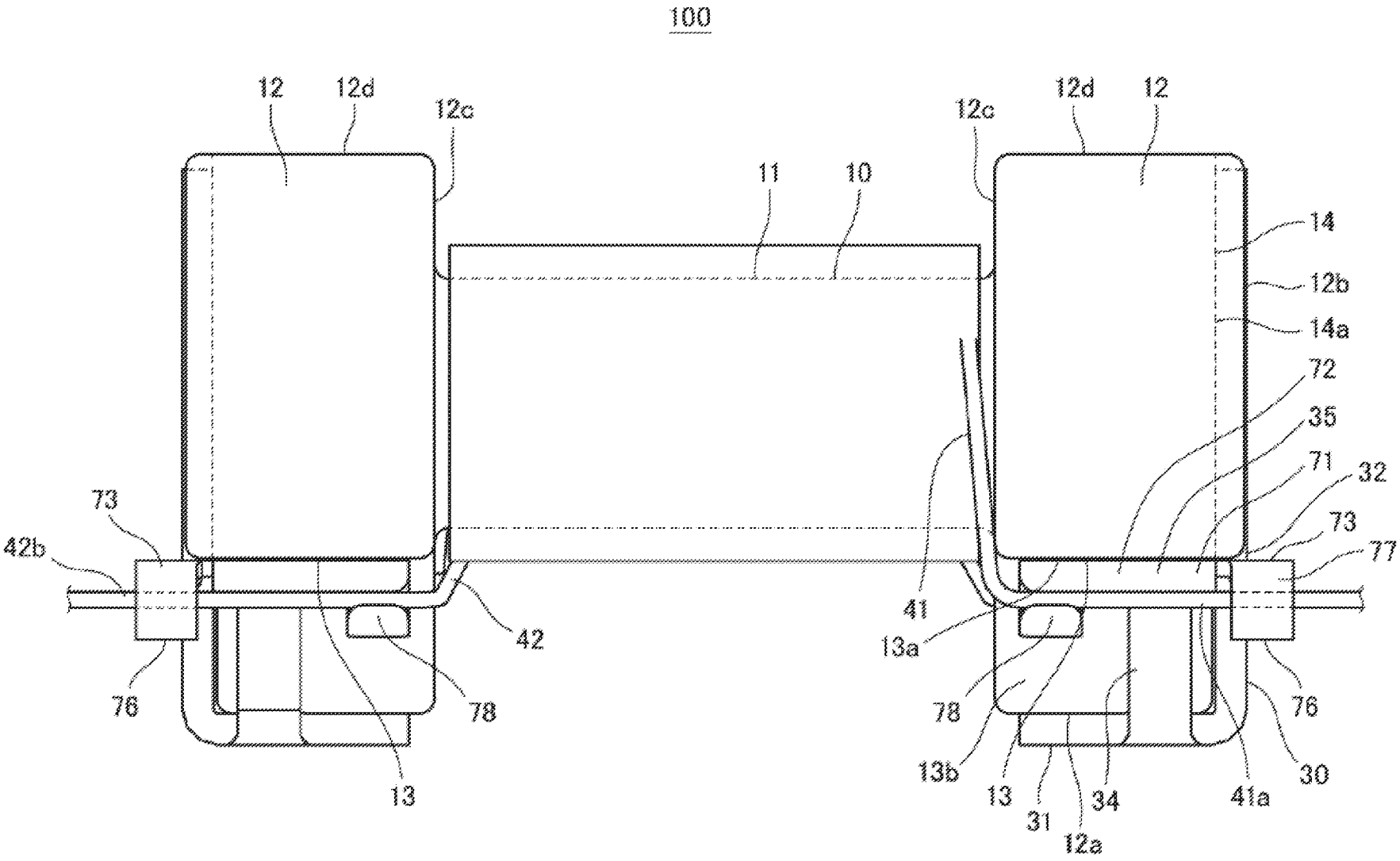
FIG. 26 is a side view that shows the coil component according to the seventh embodiment of the present invention. A state in which the wire end is crimped and fixed is shown.
Figure 27:
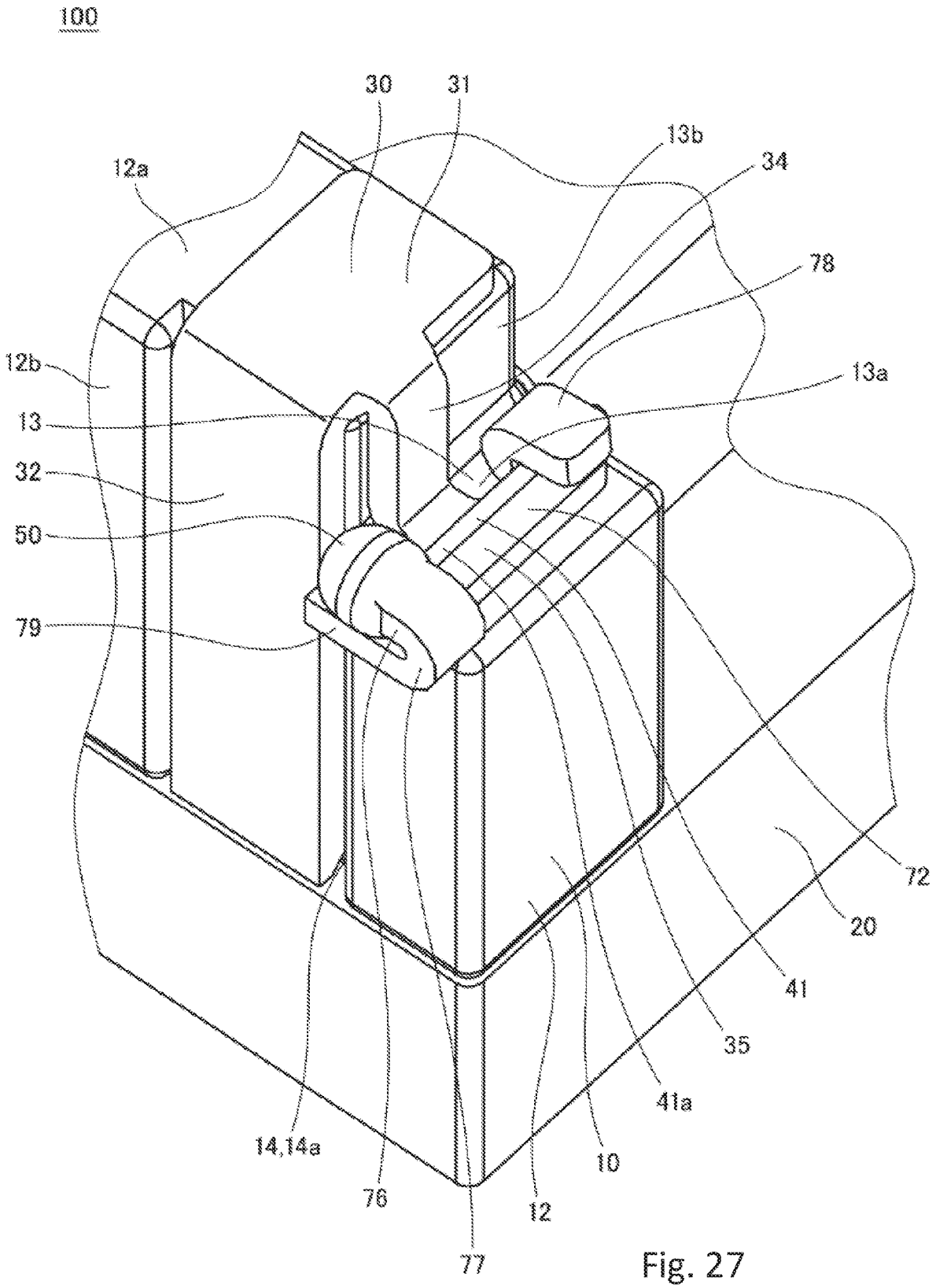
FIG. 27 is a partial enlarged perspective view that shows the coil component viewed from the bottom surface according to the seventh embodiment of the present invention. A state is shown after welding is conducted.

As shown in FIGS. 25-27, the crimp piece 76 projects toward the external side in the axial direction than the flange part 12. More specifically, the crimp piece 76 is provided at the external side in the axial direction than the vertical direction extension part 14*a*.

In the present embodiment, an opposing piece 79 is formed at the end of the external side in the axial direction of the first axial direction extension part 71. The opposing piece 79 is formed wider in a direction orthogonal to the axial direction as compared with the other parts of the first axial direction extension part 71. The opposing piece 79 is opposed to the crimp piece 76 when the crimp piece 76 is crimped.

Further, in the present embodiment, the metal terminal 30 has a crimp piece 78 (a first crimp piece).

The crimp piece 78 is continuously connected to the end at the inner side in the axial direction of the second axial direction extension part 72. More specifically, the crimp piece 78 is continuously connected to the inner side of the second axial direction extension part 72 in the direction orthogonal to the axial direction.

Therefore, a folding back direction (a direction from the outside to the inside) of the crimp piece 76 to (the opposing piece 79 of) the first axial direction extension part 71 and a folding back direction (a direction from the inside to the outside) of the crimp piece 78 to the second axial direction extension part 72 are opposite directions to each other.

Though an illustration is omitted from the drawings, in a state in which the crimp fixation of the wire end by utilizing the crimp piece 78 and the crimp piece 76 is not performed yet, the crimp piece 78 is in a state in which the crimp piece 78 downwardly rises from the second axial direction extension part 72. The crimp piece 76 is in a state in which the crimp piece 76 downwardly rises from the first axial direction extension part 71 (via the connection part 77). In these states, for instance, the crimp piece 78 is bent substantially perpendicularly to the second axial direction extension part 72 and the crimp piece 76 is bent substantially perpendicularly to the first axial direction extension part 71.

As shown in FIGS. 25 and 26, in a state in which the crimp fixation of the wire end by utilizing the crimp piece 78 and the crimp piece 76 is already performed, the crimp piece 78 is in the folded-back shape that is obtained by being folded back from the second axial direction extension part 72 and the crimp piece 76 is in the folded-back shape that is obtained by being folded back from (the opposing piece 79 of) the first axial direction extension part 71 (via the connection part 77). That is, the crimp piece 78 and the second axial direction extension part 72 are opposed to each other so as to sandwich the wire end therebetween. Thus, the wire end is crimped and fixed by being held by the crimp piece 78 and the second axial direction extension part 72. At the same time, the crimp piece 76 and the opposing piece 79 of the first axial direction extension part 71 are opposed to each other so as to sandwich the wire end therebetween. Thus, the wire end is crimped and fixed by being held by the crimp piece 76 and the opposing piece 79 of the first axial direction extension part 71.

As shown in FIG. 27, in a state in which the welding is already performed, for instance, a part of the crimp piece 76 is melted and integrated with the wire end. As a result, the weld ball 50 is formed.

However, the present invention is not limited to the above features. The parts of each of the crimp pieces 76 and the first axial direction extension part (for instance, the opposing piece 79 of the first axial direction extension part 71) can be melted and integrated with the wire end. Further, only a part of the first axial direction extension part 71 among the crimp piece 76 and the first axial direction extension part 71 can also be melted and integrated with the wire end.

Further, in the present embodiment, for instance, the bottom plate 31 extends closer to the inner side in the axial direction as compared with the raised part 34.

As explained above, the notch shape part 13 has the raised surface 13*b* and the notch opposite surface 13*a*. Specifically, the raised surface 13*b* is parallel to the axial direction and is orthogonal to the opposite surface 12*a*. The notch opposite surface 13*a* is provided opposite to the mounting target surface. The metal terminal 30 has the bottom plate 31, the raised part 34, the notch opposite surface arrangement section 35, and the axial direction extension part (the first axial direction extension part 71 and the second axial direction extension part 72). Specifically, the bottom plate 31 is provided along the opposite surface 12*a* of the flange part 12. The raised part 34 rises from the bottom plate 31 along the raised surface 13*b* of the notch shape part 13. The notch opposite surface arrangement section 35 extends from the raised part 34 along the notch opposite surfaces 13*a* of the notch shape part 13. The axial direction extension part (the first axial direction extension part 71 and the second axial direction extension part 72) extends from the notch opposite surface arrangement section 35 in the axial direction. The wire end is fixed by the welding at the position that is located at the external side in the axial direction and at the tip side of the axial direction extension part of the metal terminal 30.

Further, the metal terminal 30 has the first crimp piece (the crimp piece 78) and the second crimp piece (the crimp piece 76). Specifically, the first crimp piece (the crimp piece 78) is in the folded-back shape that is obtained by being folded back from the axial direction extension part (here, the second axial direction extension part 72) and crimps and fixes the wire end. The second crimp piece (the crimp piece 76) is in the folded-back shape that is obtained by being folded back from the axial direction extension part (here, the first axial direction extension part 71) and crimps and fixes the wire end. The second crimp piece is provided at the external side in the axial direction than the first crimp piece. The wire end is welded to the end of the external side in the axial direction of at least one of the second crimp piece and the axial direction extension part. Therefore, each of the wire ends can be respectively and more stably fixed by two of the crimp pieces.

Further, because the wire end is respectively crimped and fixed by the first crimp piece and the second crimp piece, the tension of the wire end between the first crimp piece and the second crimp piece can be reduced. In other words, the tension of the wire end can be dispersed to the first crimp piece and the second crimp piece. As a result, the damage and the disconnection (breaking) of the wire end such as at the time of the welding can be suppressed.

Further, even in the present invention, the recessed part 14 can have the horizontal direction extension part 14*b*, and in that case, it is preferred that the crimp piece 76 is provided at the external side in the axial direction than the horizontal direction extension part 14*b*. That is, even in the present invention, it is preferred that the second crimp piece (the crimp piece 76) is provided at the external side in the axial direction than the portion (the horizontal direction extension part 14*b*) that is adjacent to the notch opposite surfaces 13*a* on the surface (the outer surface 12*b*) of the flange part 12 at the external side in the axial direction. As a result, it can make the flange part 12 hardly become an obstacle when the second crimp piece is crimped.

Further, the folding back direction of the first crimp piece (the crimp piece 78) and the folding back direction of the second crimp piece (the crimp piece 76) are opposite directions to each other. Therefore, the wire end can be more stably crimped and fixed by the first crimp piece and the second crimp piece.

Next, an example of the procedure to manufacture the coil component 100 according to the present embodiment will be explained below.

First, the first wire 41 and the second wire 42 are wound around the shaft part 11. Thus, the one end 41*a* and the other end 41*b* of the first wire 41 and the one end 42*a* and the other end 42*b* of the second wire 42 are arranges along the second axial direction extension part 72, the notch opposite surface arrangement section 35, and the first axial direction extension part 71 of the corresponding metal terminal 30.

Further, the part of the tip side beyond the portion that is provided along the first axial direction extension part 71 of each of the wire ends (the one end 41*a*, the other end 41*b*, the one end 42*a*, and the other end 42*b*) is held by an external jig (not shown).

Next, as shown in FIGS. 25 and 26, the crimp piece 78 and the crimp piece 76 of each of the metal terminals 30 are bent toward the second axial direction extension part 72 and the first axial direction extension part 71, respectively so that each of the wire ends is crimped and fixed by the crimp piece 78 and the crimp piece 76.

Next, for instance, by irradiating a laser beam to the crimp piece 76 of each of the metal terminals 30, the part of the crimp piece 76 and each of the wire ends (the one end 41*a*, the other end 41*b*, the one end 42*a*, and the other end 42*b*) are welded. As a result, the weld ball 50 (shown in FIG. 27) is formed. The irradiation direction of the laser beam is, for instance, the upward direction from below. As explained above, each of the wire ends is welded to and is electrically connected to the corresponding metal terminal 30.

Thereafter, in the same way as the first embodiment, the plate core 20 is fixed to the drum core 10. As a result, the coil component 100 that has the drum core 10 and the plate core 20 can be obtained.

Eighth Embodiment

Figure 29:
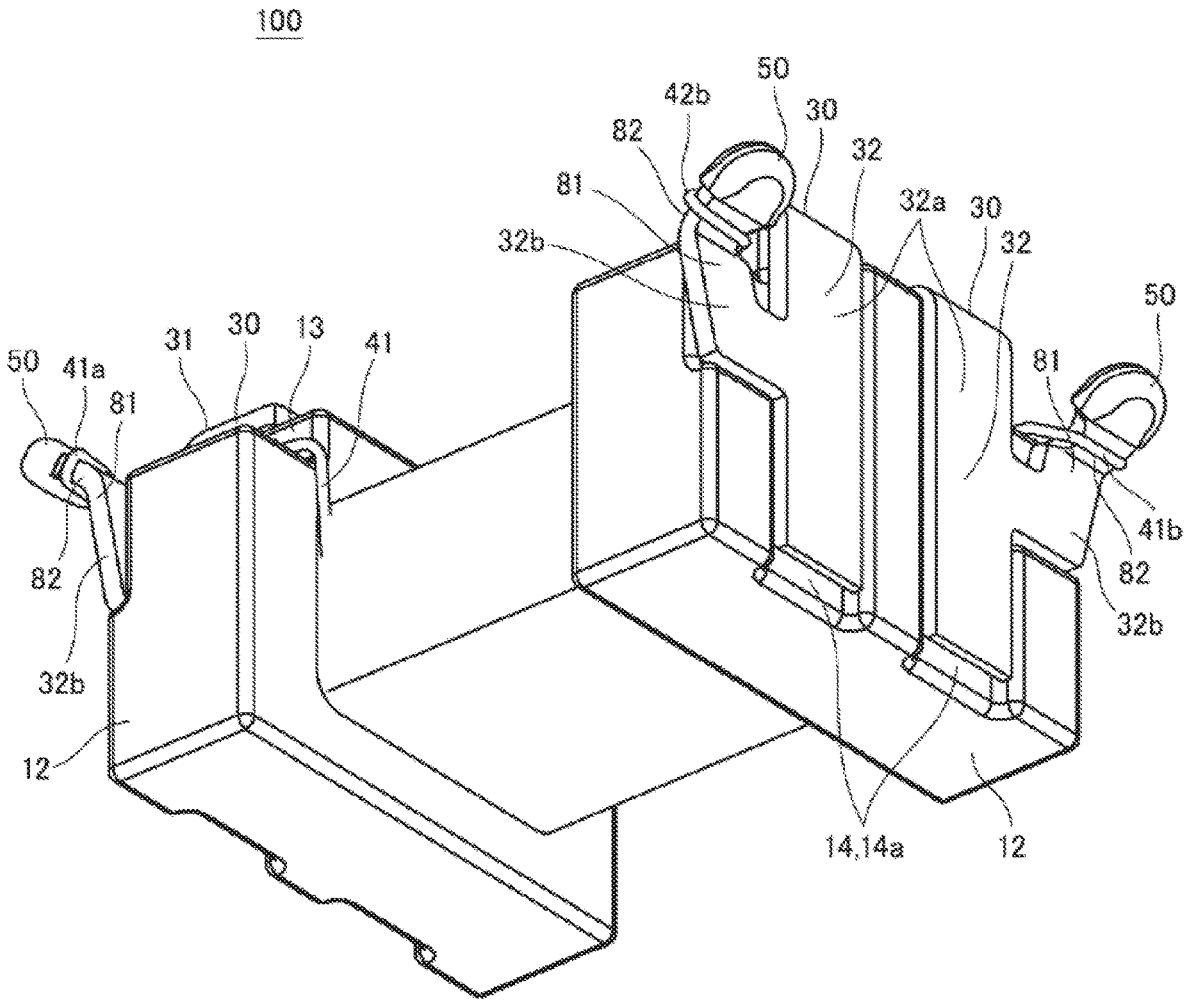
FIG. 29 is a perspective view that shows the coil component according to the eighth embodiment of the present invention. A state is shown after welding is conducted.
Figure 30:
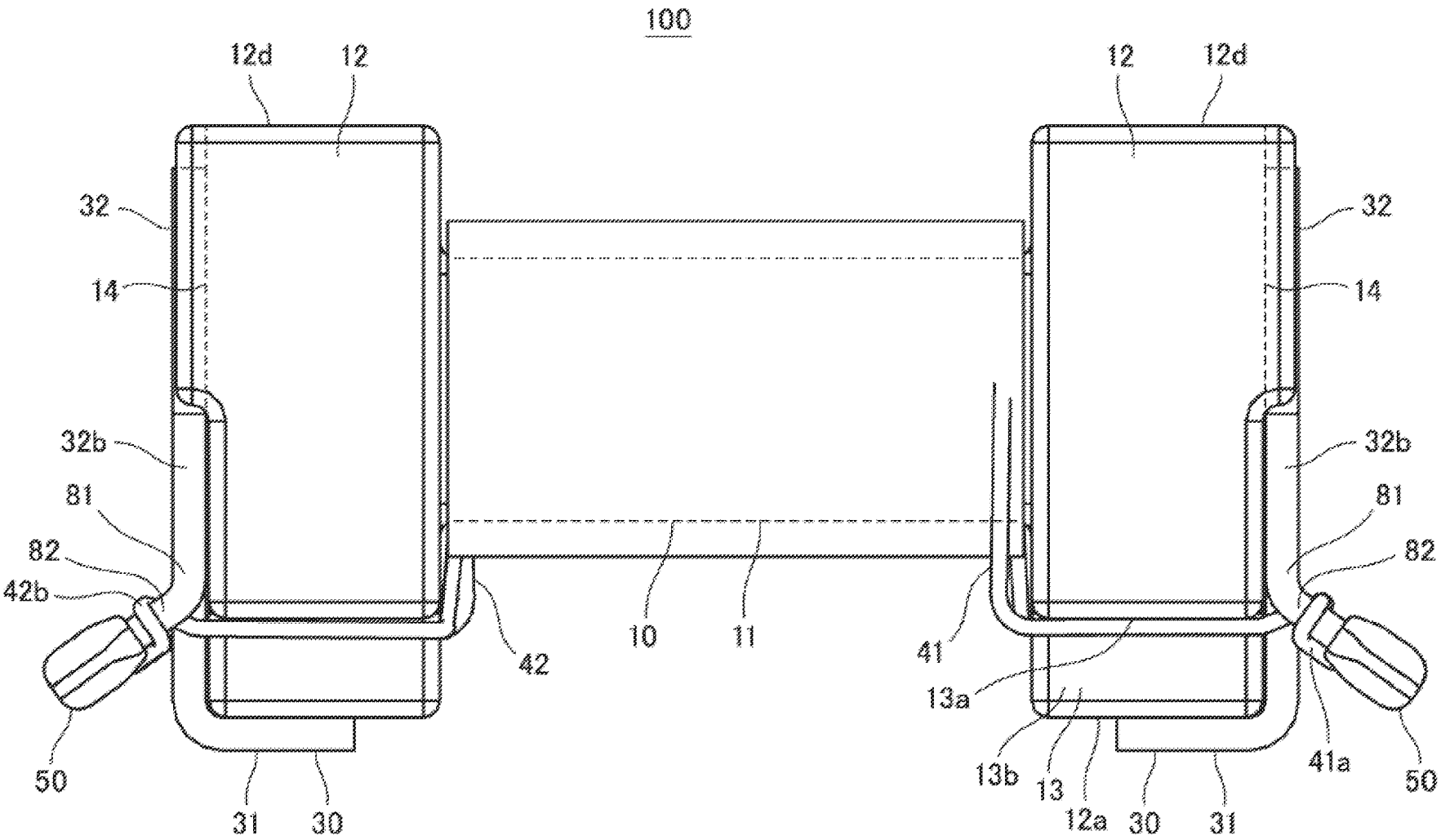
FIG. 30 is a side view that shows the coil component according to the eighth embodiment of the present invention. A state is shown after welding is conducted.

Next, an eighth embodiment of the present invention will be explained below with reference to FIGS. 28-30.

Figure 28:
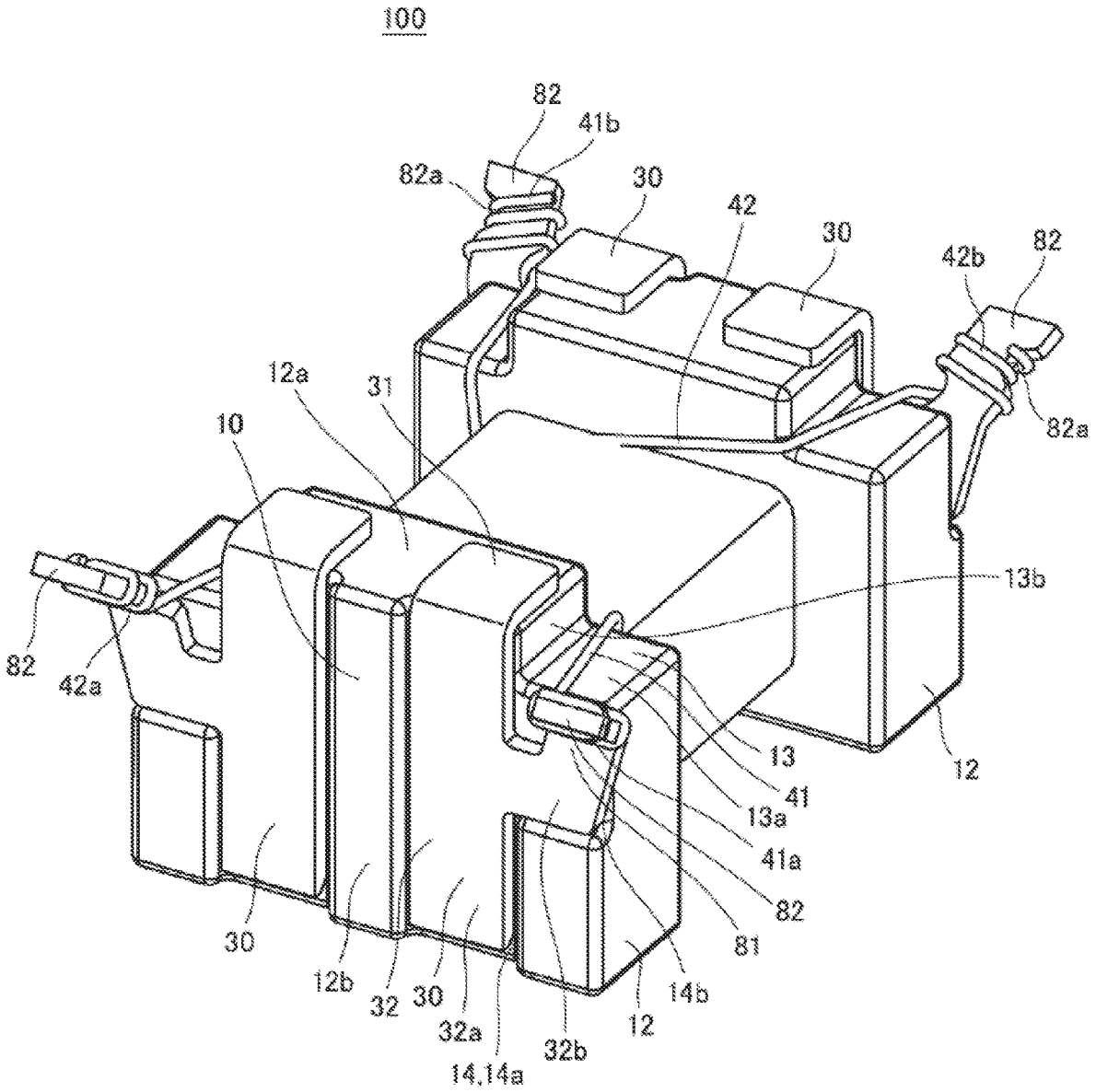
FIG. 28 is a perspective view that shows a coil component viewed from a bottom surface according to an eighth embodiment of the present invention. A state in which the wire end is entwined to the metal terminal is shown.

FIG. 28 is a perspective view that shows a coil component 100 viewed from a bottom surface according to an eighth embodiment of the present invention. FIG. 28 shows a state in which a wire end is entwined to the metal terminal 30. FIG. 29 is a perspective view that shows the coil component 100 according to the eighth embodiment of the present invention. FIG. 30 is a side view that shows the coil component 100 according to the eighth embodiment of the present invention. FIGS. 29 and 30 show a state in which the welding is already performed.

The coil component 100 according to the present embodiment is different from the coil component 100 according to the first embodiment explained above with respect to the configuration of the metal terminal 30. In other respects (configurations), the coil component 100 according to the present embodiment is configured in the same way as the coil component 100 according to the first embodiment explained above.

In the present embodiment, the metal terminal 30 does not have the raised part 34, the notch opposite surface arrangement section 35, the entwining part 36, and the cut part 31*a* that are respectively shown in FIG. 2.

As shown in FIG. 28, the metal terminal 30 has a raised part 81 and a projection piece 82. Specifically, the raised part 81 rises from the horizontal direction extension part 32*b* toward the mounting target surface. The projection piece 82 obliquely projects from the raised part 81 toward the external side in the axial direction. In the present embodiment, the flat base part 32 is configured by including the raised part 81.

Further, though the raised part 81 is, for instance, provided on the same plane as the flat base part 32 (the vertical direction extension part 32*a* and the horizontal direction extension part 32*b*), the raised part 81 obliquely rises toward a direction crossing the axial direction so as to laterally project from the flange part 12. That is, the left raised part 81 projects from the left end surface of the flange part 12 toward the left side and the right raised part 81 projects from the right end surface of the flange part 12 toward the right side.

Each of the wire ends is pulled outside in the axial direction through the space defined by the notch shape part 13 so as to be connected to each of the metal terminals 30.

For instance, a constricted part 82*a* is formed in one side of the projection piece 82. Each of the wire ends is entwined to the constricted part 82*a*. Further, for instance, the part of the tip side beyond the constricted part 82*a* of the projection piece 82 is melted and integrated with the wire end by the welding. As a result, a weld ball 50 (shown in FIGS. 29 and 30) is formed.

As explained above, the coil component 100 according to the embodiment of the present invention includes the core (the drum core 10), the first and second wires 41 and 42, and the plurality of metal terminals 30. Specifically, the core (the drum core 10) has the shaft part 11 (shown in FIG. 30) and the flange parts 12 that are formed at both ends of the shaft part 11. The first and second wires 41 and 42 are wound around the shaft part 11. The corresponding wire end (any of one end 41*a*, the other end 41*b*, one end 42*a*, and the other end 42*b*) of both ends (one end 41*a* and the other end 41*b*) of the first wire 41 and both ends (one end 42*a* and the other end 42*b*) of the second wire 42 is connected to the corresponding one of the plurality of metal terminals 30. In regards to the opposite surface 12*a* of each of the flange parts 12 that is provided opposite to the mounting target surface, the notch shape part 13 is respectively formed at the both ends in the direction orthogonal to the axial direction of the shaft part 11. The wire end is pulled outside in the axial direction via the notch shape part 13 and is connected to the metal terminal 30.

As a result, the connection of the wire end to the metal terminal 30 can be performed at the outside of the notch shape part 13 while avoiding the interference with the flange part 12. Therefore, the process in which the wire end is connected to the metal terminal 30 can be easily performed. That is, the good manufacturing easiness of the coil component 100 can be secured.

Further, the metal terminal 30 has the flat base part 32 and the projection piece 82. Specifically, the flat base part 32 is provided along the surface of the flange part 12 at the external side in the axial direction and is orthogonal to the axial direction. The projection piece 82 obliquely projects from the flat base part 32 toward the external side in the axial direction. The wire end is welded to the projection piece 82. Therefore, when the wire end is connected to the metal terminal 30 by the welding, it preferably makes the flange part 12 hardly become the obstacle. As a result, it is further easy to manufacture the coil component 100.

The embodiments according to the present invention explained above also include the technical concepts or idea described below.

(1) A coil component including: a core that is configured with a shaft and first and second flanges, the first and second flanges being formed at first and second opposite ends of the shaft; first and second wires that are wound around the shaft; and a plurality of metal terminals to which both wire ends of each of the first and second wires are connected, respectively. A notch is formed in both ends in a first direction of an opposite surface of each of the first and second flanges. The opposite surface faces a mounting surface on which the coil component is mounted. The first direction is perpendicular to an axial direction of the shaft. At least part of each of the plurality of metal terminals is disposed in the notch.

(2) In the coil component according to the above aspect (1), the notch has a raised surface and an opposing surface. The raised surface is perpendicular to the opposite surface of each of the first and second flanges and extends parallel to the axial direction. The opposing surface of the notch faces the mounting surface. Each of the plurality of metal terminals is configured with: a bottom plate that is disposed along the opposite surface of corresponding one of the first and second flanges; a raised segment that rises along the raised surface of the notch from the bottom plate; an arrangement plate that extends along the opposite surface of the notch from the raised segment; and an axial direction extension plate that extends in the axial direction from the arrangement plate. One of the corresponding wire ends is welded to a tip of the axial direction extension plate, and the tip is located at an axially external side of each of the plurality of metal terminals.

(3) In the coil component according to the above aspect (2), each of the plurality of metal terminals is configured with: a first crimp piece that is folded back from at least one of the axial direction extension plate or the arrangement plate so as to crimp a first end of the wire ends; and a second crimp piece that is folded back from the axial direction extension plate so as to crimp the first end of the wire ends. The second crimp piece is located closer to the axially external side than the first crimp piece. The first end is welded to the tip of at least one of the second crimp piece or the axial direction extension plate.

(4) In the coil component according to the above aspect (3), an end surface at the tip of the axial direction extension plate in the axial direction is located on the same plane as an end surface at the tip of the second crimp piece in the axial direction or is located further at the axially external side than the end surface at the tip of the second crimp piece.

(5) In the coil component according to the above aspect (3) or aspect (4), the second crimp piece is located further at the axially external side than a horizontal direction extension part formed in an external end surface of one of the first and second flanges in the axial direction.

(6) In the coil component according to one of the above aspects (3) to (5), the first and second crimp pieces configure a monolithic piece that is folded back from at least one of the axial direction extension plate or the arrangement plate.

(7) In the coil component according to one of the above aspects (3) to (5), a fold-back direction of the first crimp piece is opposite to a fold-back direction of the second crimp piece.

(8) In the coil component according to the above aspect (2), each of the plurality of metal terminals is configured with: a positioning raised tab that rises toward the mounting surface from one of the arrangement plate and the axial direction extension plate so as to position a first end of the wire ends in the first direction; and a crimp piece that is folded back from the axial direction extension plate so as to crimp the first end of the wire ends. The crimp piece is located closer to the axially external side than the positioning raised tab. The first end is welded to the tip of at least one of the crimp piece or the axial direction extension plate.

(9) In the coil component according to the above aspect (8), each of the plurality of metal terminals is configured with a lateral projection that laterally projects from at least one of the axial direction extension plate or the arrangement plate. The lateral projection is configured to regulate movement of the first end of the wire ends toward the mounting surface between the positioning raised tab and the crimp piece.

(10) In the coil component according to the above aspect (8) or aspect (9), the positioning raised tab rises from an axially internal side of each of the plurality of metal terminals located along the opposing surface of the notch.

(11) In the coil component according to one of the above aspects (8) to (10), the positioning raised tab extends parallel to the axial direction.

(12) In the coil component according to the above aspect (1), each of the plurality of metal terminals is configured with: an entwining tab to which a first end of the wire ends is entwined; and a weld tab to which the first end is welded. The entwining tab is provided at the notch.

(13) In the coil component according to the above aspect (12), an external surface in the axial direction of each of the first and second flanges has a recess or a groove. Each of the plurality of metal terminals has an external plate in the recess, and the external plate extends in a direction perpendicular to the axial direction. The weld tab continuously rises from the external plate toward a side of the mounting surface and is located adjacent to an external side in the axial direction of the notch.

(14) In the coil component according to the above aspect (1), the notch has a raised surface and an opposing surface. The raised surface is perpendicular to the opposite surface of each of the first and second flanges and extends parallel to the axial direction. The opposing surface faces the mounting surface. Each of the plurality of metal terminals is configured with: a bottom plate that is disposed along the opposing surface of corresponding one of the first and second flanges; a raised segment that rises along the raised surface of the notch from the bottom plate; an arrangement plate that extends along the opposing surface of the notch from the raised segment; an entwining tab that rises from the arrangement plate, the entwining tab facing the raised segment, a first wire end of the wire ends being entwined to the entwining tab; an axial direction extension plate that extends in the axial direction from the arrangement plate; and a crimp piece that is folded back from the axial direction extension plate so as to crimp the first end of the wire ends. The entwining tab is provided at the notch. The first end is welded to the tip of at least one of the crimp piece or the axial direction extension plate.

(15) In the coil component according to the above aspect (14), the crimp piece is located closer to the axially external side than a horizontal direction extension part formed in an external end surface of one of the first and second flanges.

(16) A coil component including: a core that is configured with a shaft and first and second flanges, the first and second flanges being formed at first and second opposite ends of the shaft; and a plurality of metal terminals to which both wire ends of each of first and second wires are connected, respectively, the first and second wires being wound around the shaft. A notch is formed in both ends in a first direction of an opposite surface of each of the first and second flanges. The opposite surface faces a mounting surface on which the coil component is mounted, and the first direction is perpendicular to an axial direction of the shaft. At least part of each of the plurality of metal terminals is disposed in the notch.

(17) A coil component including: a core that is configured with a shaft and first and second flanges, the first and second flanges being formed at first and second opposite ends of the shaft; first and second wires that are wound around the shaft; and a plurality of metal terminals to which both wire ends of each of the first and second wires are connected, respectively. A notch is formed in both ends in a first direction of an opposite surface of each of the first and second flanges.

The opposite surface faces a mounting surface on which the coil component is mounted. The first direction is perpendicular to an axial direction of the shaft. Each of the wire ends is pulled toward an axially external side of corresponding one of the first and second flanges via corresponding one of the notches so as to connect corresponding one of the plurality of metal terminals.

(18) In the coil component according to the above aspect (17), each of the plurality of metal terminals is configured with: an external plate that is provided along the axially external side of corresponding one of the first and second flanges and that is orthogonal to the axial direction; and a projection piece that obliquely projects toward the axially external side from the external plate. Each of the wire ends is welded to corresponding one of the projection pieces.

The coil component being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A coil component comprising:

a core that is configured with a shaft and first and second flanges, the first and second flanges being formed at first and second opposite ends of the shaft;

first and second wires that are wound around the shaft; and a plurality of metal terminals to which both wire ends of each of the first and second wires are connected, respectively, wherein a notch is formed in both ends in a first direction of an opposite surface of each of the first and second flanges, the opposite surface faces a mounting surface on which the coil component is mounted, and the first direction is perpendicular to an axial direction of the shaft, at least part of each of the plurality of metal terminals is disposed in the notch wherein the notch has a raised surface and an opposing surface, the raised surface is perpendicular to the opposite surface of each of the first and second flanges and extends parallel to the axial direction, and the opposing surface of the notch faces the mounting surface, wherein each of the plurality of metal terminals is configured with:

a bottom plate that is disposed along the opposite surface of corresponding one of the first and second flanges;

a raised segment that rises along the raised surface of the notch from the bottom plate;

an arrangement plate that extends along the opposite surface of the notch from the raised segment; and an axial direction extension plate that extends in the axial direction from the arrangement plate, and one of the corresponding wire ends is welded to a tip of the axial direction extension plate, and the tip is located at an axially external side of each of the plurality of metal terminals.

2. The coil component according to claim 1, wherein each of the plurality of metal terminals is configured with:

a first crimp piece that is folded back from the arrangement plate so as to crimp a first end of the wire ends; and a second crimp piece that is folded back from the axial direction extension plate so as to crimp the first end of the wire ends, the second crimp piece is located closer to the axially external side than the first crimp piece, and the first end is welded to the tip of the axial direction extension plate.

3. The coil component according to claim 2, wherein an end surface at the tip of the axial direction extension plate in the axial direction is located on the same plane as an end surface at the tip of the second crimp piece in the axial direction.

4. The coil component according to claim 2, wherein the second crimp piece is located further at the axially external side than a horizontal direction extension part formed in an external end surface of one of the first and second flanges in the axial direction.

5. The coil component according to claim 2, wherein the first and second crimp pieces configure a monolithic piece that is folded back from the arrangement plate.

6. The coil component according to claim 2, wherein a fold-back direction of the first crimp piece is opposite to a fold-back direction of the second crimp piece.

7. The coil component according to claim 1, wherein each of the plurality of metal terminals is configured with:

a positioning raised tab that rises toward the mounting surface from the arrangement plate so as to position a first end of the wire ends in the first direction; and a crimp piece that is folded back from the axial direction extension plate so as to crimp the first end of the wire ends, the crimp piece is located closer to the axially external side than the positioning raised tab, and the first end is welded to the tip of the crimp piece.

8. The coil component according to claim 7, wherein each of the plurality of metal terminals is configured with a lateral projection that laterally projects from the arrangement plate, and the lateral projection is configured to regulate movement of the first end of the wire ends toward the mounting surface between the positioning raised tab and the crimp piece.

9. The coil component according to claim 7, wherein the positioning raised tab rises from an axially internal side of each of the plurality of metal terminals located along the opposing surface of the notch.

10. The coil component according to claim 7, wherein the positioning raised tab extends parallel to the axial direction.

11. A coil component comprising:

a core that is configured with a shaft and first and second flanges, the first and second flanges being formed at first and second opposite ends of the shaft;

first and second wires that are wound around the shaft; and a plurality of metal terminals to which both wire ends of each of the first and second wires are connected, respectively, wherein a notch is formed in both ends in a first direction of an opposite surface of each of the first and second flanges, the opposite surface faces a mounting surface on which the coil component is mounted, and the first direction is perpendicular to an axial direction of the shaft, at least part of each of the plurality of metal terminals is disposed in the notch wherein an external surface in the axial direction of each of the first and second flanges has a recess, each of the plurality of metal terminals has an external plate in the recess, and the external plate extends in a direction perpendicular to the axial direction, and a weld tab continuously rises from the external plate toward a side of the mounting surface and is located adjacent to an external side in the axial direction of the notch.

* * * * *